US006486864B1

(12) United States Patent
Nakajima et al.

(10) Patent No.: US 6,486,864 B1
(45) Date of Patent: Nov. 26, 2002

(54) LIQUID CRYSTAL DISPLAY DEVICE, AND METHOD FOR DRIVING THE SAME

(75) Inventors: Mutsumi Nakajima, Nara (JP); Koichi Miyachi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/518,815

(22) Filed: Mar. 3, 2000

(30) Foreign Application Priority Data

Mar. 10, 1999 (JP) ..... 11-064083
Mar. 10, 1999 (JP) ..... 11-064084

(51) Int. Cl.[7] ..... G09G 3/36
(52) U.S. Cl. ..... 345/92; 345/100
(58) Field of Search ..... 345/93–98, 87, 345/205–206, 208–210, 62, 89, 90, 76, 94, 92

(56) References Cited

U.S. PATENT DOCUMENTS 5,784,039 A * 7/1998 Yasui et al. ..... 345/89
6,344,842 B1 * 2/2002 Hebiguchi ..... 345/96

FOREIGN PATENT DOCUMENTS

JP 56-27198 3/1981
JP 2-913 1/1990
JP 4-42211 2/1992
JP 9-138421 5/1997

OTHER PUBLICATIONS

H. Nakamura, et al., "SID 98 Digest: A Novel Wide–Viewing–Angle Motion–Picture LCD"; p. 143–146 (1998).

* cited by examiner

*Primary Examiner*—Vijay Shankar
*Assistant Examiner*—Nitin Patel
(74) *Attorney, Agent, or Firm*—Dike, Bronstein, Roberts & Cushman; David G. Conlin; David A. Tucker

(57) ABSTRACT

A liquid crystal display device of the present invention includes: first and second electrodes crossing each other; switching elements in a vicinity of each first and second electrode intersection; pixel electrodes respectively arranged in a matrix and partitioned from one another by the first and second electrodes; the first electrodes supplied with a gate voltage for turning ON/OFF the switching elements and the second electrodes supplied with a source voltage; third electrodes supplied with a common voltage; and a liquid crystal layer interposed between the third electrodes and the pixel electrodes. The source voltage includes an image signal voltage and an assist signal voltage. The common voltage has different values between an image signal writing scanning period defined as a period during which the image signal voltage is applied, and at least one assist signal writing scanning period defined as a period during which the assist signal voltage is applied.

31 Claims, 23 Drawing Sheets

LIQUID CRYSTAL DISPLAY DEVICE, AND METHOD FOR DRIVING THE SAME

BACKGROUND OF THE INVENTION

1. Field of the Invention

The present invention relates to a liquid crystal display device for use in a television set, a computer, a word processor, an OA (Office Automation) apparatus, or the like, and a method for driving such a liquid crystal display device.

2. Description of the Related Art

FIG. 20 illustrates an equivalent circuit diagram of a typical active matrix type licquid crystal display device.

The liquid crystal display device includes a plurality of gate electrodes 61 and a plurality of source electrodes 62 crossing the gate electrodes 61. A switching element 63, e.g., a thin film transistor, is provided in the vicinity of each intersection of the gate electrode 61 and the source electrode 62. The display area is divided into a plurality of pixel regions arranged in a matrix, which are partitioned from one another by the gate electrodes 61 and the source electrodes 62. A pixel electrode 64 is provided in each of the pixel regions. The pixel electrode 64 is connected to the source electrode 62 via the switching element 63. A liquid crystal layer (not shown) is interposed between the pixel electrode 64 and a common electrode 65. A liquid crystal capacitor 66 is provided between the pixel electrode 64 and the common electrode 65. An image is displayed by holding an intended voltage in each liquid crystal capacitor 66.

FIG. 21 illustrates typical voltage waveforms used for driving such an active matrix type liquid crystal display device.

A pulse waveform of ON voltage Vgh for turning ON the switching element 63 is applied as a gate voltage Vg to the gate electrodes 61 for each field period. A plurality of such pulses are sequentially applied to scan the entire frame. A voltage corresponding to an image signal for the row for which the ON voltage Vgh is being input to the gate electrode 61 is applied as a source voltage Vs to the source electrode 62. A plurality of such image signals are applied sequentially. As a common voltage Vc, ±Vcac is applied to the common electrode 65. Each time the ON voltage Vgh is applied to the gate electrode 61, a new source voltage Vs is applied to the pixel electrode 64 as a pixel voltage Vp. As a result, a liquid crystal voltage Vlc, which is equal to the difference between the pixel voltage Vp and the common voltage Vc, is applied through the liquid crystal layer.

FIG. 22 illustrates the relationship between the liquid crystal voltage Vlc and the transmission. FIG. 22 shows an example for a TN (twisted nematic) type normally white mode which has been used in the art as a typical liquid crystal display mode.

The output range $\pm Vs^{max}$ of the source voltage Vs is normally set to the voltage difference between a voltage $Vlc^a$ at which the 100% transmission is obtained and a voltage $Vlc^c$ at which about 1% transmission is obtained. Thus, the output range of the source voltage Vs is set to a minimum range required to obtain a practically sufficient contrast. When the output range of the source voltage Vs is set to be higher than this, a source driver having a high voltage resistance is required, thereby increasing the cost of the device. Therefore, the source voltage Vs and the common voltage Vc with respect to the liquid crystal voltage Vlc are set as shown in the following Expression 1.

$$Vlc^a=[+Vs^{max}\pm Vcac|$$

$$Vlc^b=[+Vcac|$$

$$Vlc^c=[+Vs^{max}\pm Vcac| \qquad \text{Expression 1}$$

FIG. 23 illustrates transmission response characteristics of the liquid crystal panel. In FIG. 23, a solid line shows the change in the transmission obtained when the image signal is changed from white display→black display→white display, and a broken line shows the change in the transmission obtained when the image signal is changed from white display→gray-level display→white display.

FIG. 23 shows that when the image signal is changed from white display→black display→white display, each transmission response is substantially completed within one field period. However, when the image signal is changed from white display→gray-level display→white display, the transmission does not change to a transmission corresponding to the image signal within one field period. Thus, between two image signals where the voltage difference is small, the transmission response may be slow.

Liquid crystal display devices have been wide spread as thin display devices as the image qualities thereof, e.g., the contrast, the brightness, and the color reproducibility, have been improved and are now comparable to those of other types of display devices such as CRTs. However, liquid crystal display devices have a relatively slow response as described above. Therefore, when displaying a motion picture on a liquid crystal display device, the displayed picture may be blurred or the after-image phenomenon may occur. This drawback has prevented liquid crystal display devices from replacing CRTs in some applications.

Japanese Laid-Open Publication No. 56-27198 discloses a display device which produces a color display by using a black and white liquid crystal panel in combination with a light source whose output color is switched among red, blue and green. This is called a "field sequential color method".

In this method, the output color of the light source is switched among red, blue and green while an image corresponding to each output color is synchronously displayed. Therefore, when displaying a color image, the image signal changes for each display operation even if the image is stationary. Thus, when the response of the liquid crystal panel is slow, the color information for one display operation and the color information for the next display operation may be mixed together, thereby reducing the color reproducibility. In such a case, it is difficult to realize a sufficient display performance.

As described above, the slow response of the liquid crystal panel has been a drawback which deteriorates the display performance. In order to address such a drawback, various methods have been proposed in the art as follows.

For example, Japanese Laid-Open Publication No. 4-42211 proposes a method in which a voltage corresponding to an assist signal, which is different from an image signal, is applied before applying a voltage corresponding to the image signal. This method is based on the fact that the effective liquid crystal response speed (i.e., the speed of the response of the liquid crystal molecules to an applied voltage) can be increased by applying a voltage which is larger or lower than the voltage corresponding to the image signal through the liquid crystal layer before applying the voltage corresponding to the image signal therethrough. This method improves the motion picture display quality.

"SID 98 DIGEST P. 143 A Novel Wide-Viewing Angle Motion-Picture LCD" proposes another method in which a voltage corresponding to an assist signal is applied before applying a voltage corresponding to an image signal. This method improves the motion picture display quality by erasing the displayed image before displaying the next image.

Japanese Laid-Open Publication No. 9-138421 proposes a driving method in which a voltage corresponding to an assist signal is applied by activating all scanning lines and then providing the assist signal by varying the common voltage at each common electrode before applying the voltage corresponding to the image signal.

It is possible to prevent the color reproducibility from being reduced by applying the above-described improvements to the field sequential color method.

As described above, it is possible to increase the liquid crystal response by providing a period for the application through the liquid crystal panel of a voltage corresponding to an assist signal, which is not an image signal, before the period for the application of a voltage corresponding to the image signal. In order to effectively improve the liquid crystal response, it is important to appropriately set the voltage value of the assist signal and the length of the period for the application of the voltage corresponding to the assist signal.

Generally, as the amount of change in the voltage to be applied through the liquid crystal layer is larger, it is possible to impart a larger energy to the liquid crystal molecules thereby increasing the response of the display device. Therefore, the voltage value corresponding to the assist signal is preferably set to a voltage value which exceeds the voltage range for the image signals. It is further preferred that the voltage corresponding to the assist signal is variable according to the voltage corresponding to the image signal.

The above-described driving method increase the response speed of the liquid crystal panel by utilizing the transitional response in the period for the application of the voltage corresponding to the assist signal. Therefore, it is preferred that the period for the application of the voltage corresponding to the assist signal can be set to an optimal period for the response characteristics of the liquid crystal panel to be used.

However, the above-described driving method suffers from the following operational limitations, and it has been difficult to effectively improve the liquid crystal response speed.

In the method of Japanese Laid-Open Publication No. 4-42211, a voltage corresponding to an assist signal, which is different from an image signal, is applied from a source electrode through a pixel electrode via a switching element before applying a voltage corresponding to the image signal from the source electrode through the pixel electrode via the switching element. Then, in order to apply a voltage which exceeds the voltage range for the image signals through the liquid crystal layer, it is necessary to increase the voltage resistance of the source driver for inputting the signal voltage to the source electrode, thereby increasing the production cost. Moreover, since the voltage corresponding to the assist signal is applied via the switching element, it is necessary to apply the voltage corresponding to the assist signal within a short period which is provided in addition to the period for the application of the voltage corresponding to the image signal. To do so, it is necessary to dramatically improve the performance of the switching element. Therefore, it is difficult to employ the method in practical use.

In the method of "SID 98 DIGEST P. 143 A Novel Wide-Viewing Angle Motion-Picture LCD", the scanning operation for applying a voltage corresponding to an image signal from a source electrode to a pixel electrode via a switching element and the scanning operation for applying a voltage corresponding to an assist signal from the source electrode to the pixel electrode via the switching element are repeated. Again, in order to apply a voltage which exceeds the voltage range for the image signals through the liquid crystal layer, it is necessary to increase the voltage resistance of the source driver for inputting the signal voltage to the source electrode, thereby increasing the production cost. Moreover, during the period in which the voltage corresponding to the assist signal is applied to the liquid crystal panel, an image signal cannot be displayed, thereby lowering the brightness of the display screen. In order to prevent such reduction of the brightness, the assist signal period is preferably set to be short. It is further preferred that the period in which the voltage corresponding to the assist signal is applied to the liquid crystal panel is set to a minimum period required for ensuring a sufficient liquid crystal response. However, in order to shorten the period in which the voltage corresponding to the assist signal is applied to the liquid crystal panel in this driving method, it is necessary to shorten the assist signal writing scanning period (i.e., the period for a scanning operation for writing the assist signal). To do so, it is necessary to increase the size of the switching element so as to improve the performance of the switching element. Thus, there may occur problems such as an increased defect rate for the switching element, thereby increasing the production cost.

In the method of Japanese Laid-Open Publication No. 9-138421, a voltage corresponding to an assist signal is applied after activating all scanning lines, whereby a constant voltage is applied through all pixels as the voltage corresponding to the assist signal. In an actual image display operation, however, the voltage corresponding to the image signal varies for various pixels, whereby it is necessary to set assist signals respectively corresponding to different image signals for the various pixels in order to reduce the response speed for each pixel, i.e., in order to reduce the amount of time required for the transmission of each pixel to reach the transmission corresponding to the image signal for that pixel. Therefore, the response speed cannot be improved effectively by using such an assist signal that is constant and does not correspond to the image signal for each pixel. Moreover, when writing the assist signal, all of the gate electrodes are activated, and the capacity load per source electrode increases, whereby it is necessary to provide a high-performance source driver capable of driving such an increased capacity load.

Moreover, in each of the above-described driving methods, the voltage corresponding to the assist signal is applied via the switching element, thereby increasing the amount of power consumed by the source driver when writing the assist signal, and thus deteriorating a feature of liquid crystal display devices, i.e., a small power consumption.

SUMMARY OF THE INVENTION

According to one aspect of this invention, a liquid crystal display device includes: a plurality of first electrodes; a plurality of second electrodes crossing the first electrodes; a plurality of switching elements each provided in a vicinity of an intersection of the first electrode and the second electrode; a plurality of pixel electrodes respectively provided in a plurality of regions which are arranged in a matrix and partitioned from one another by the first electrodes and the second electrodes; a plurality of first electrodes to each of which a gate voltage is applied for turning ON/OFF each of the switching elements; a plurality of second electrodes to each of which a source voltage is applied; and a plurality of third electrodes to each of which a common voltage is applied, the third electrodes being arranged so that a liquid crystal layer is interposed between the third electrodes and the pixel electrodes. The source voltage includes a voltage corresponding to an image signal and another voltage corresponding to an assist signal. The common voltage has different values between an image signal writing scanning period and at least one assist signal writing scanning period, the image signal writing scanning period being defined as a period during which the voltage corresponding to the image signal is applied, and the assist signal writing scanning period being defined as a period during which the voltage corresponding to the assist signal is applied.

In one embodiment of the invention, a liquid crystal capacitor is provided between one of the pixel electrodes and one of the third electrodes.

In one embodiment of the invention, a liquid crystal capacitor is provided between one of the pixel electrodes and one of the second electrodes.

According to another aspect of this invention, a liquid crystal display device includes: a plurality of first electrodes; a plurality of second electrodes crossing the first electrodes; a plurality of switching elements each provided in a vicinity of an intersection of the first electrode and the second electrode; a plurality of pixel electrodes respectively provided in a plurality of regions which are arranged in a matrix and partitioned from one another by the first electrodes and the second electrodes; a plurality of first electrodes to each of which a gate voltage is applied for turning ON/OFF each of the switching elements; a plurality of second electrodes to each of which a source voltage is applied; and a plurality of third electrodes to each of which a common voltage is applied, the third electrodes being arranged so that a liquid crystal layer is interposed between the third electrodes and the pixel electrodes. The liquid crystal display device further includes a plurality of assist electrodes to each of which an assist voltage is applied, the assist electrode having an assist capacitor being provided between each of the pixel electrodes and the assist electrode. An image signal application period is defined as a period during which a voltage corresponding to an image signal is applied between the pixel electrode and the third electrode. An assist signal application period is defined as a period during which a voltage corresponding to an assist signal is applied between the pixel electrode and the third electrode. At least one of the common voltage and the assist voltage has different values between the image signal application period and the assist signal application period.

According to still another aspect of this invention, a liquid crystal display device includes: a plurality of first electrodes; a plurality of second electrodes crossing the first electrodes; a plurality of switching elements each provided in a vicinity of an intersection of the first electrode and the second electrode; a plurality of pixel electrodes respectively provided in a plurality of regions which are arranged in a matrix and partitioned from one another by the first electrodes and the second electrodes; a plurality of first electrodes to each of which a gate voltage is applied for turning ON/OFF each of the switching elements; a plurality of second electrodes to each of which a source voltage is applied; and a plurality of third electrodes to each of which a common voltage is applied, the third electrodes being arranged so that a liquid crystal layer is interposed between the third electrodes and the pixel electrodes. The liquid crystal display device further includes a plurality of assist electrodes to each of which an assist voltage is applied, the assist electrode having an assist capacitor being provided between each of the pixel electrodes and each of the first electrodes. An image signal application period is defined as a period during which a voltage corresponding to an image signal is applied between the pixel electrode and the third electrode. An assist signal application period is defined as a period during which a voltage corresponding to an assist signal is applied between the pixel electrode and the third electrode. At least one of the common voltage and the assist voltage has different values between the image signal application period and the assist signal application period.

According to still another aspect of this invention, there is provided a method for driving a liquid crystal display device. The liquid crystal display device includes: a plurality of first electrodes; a plurality of second electrodes crossing the first electrodes; a plurality of switching elements each provided in a vicinity of an intersection of the first electrode and the second electrode; a plurality of pixel electrodes respectively provided in a plurality of regions which are arranged in a matrix and partitioned from one another by the first electrodes and the second electrodes; a plurality of first electrodes to each of which a gate voltage is applied for turning ON/OFF each of the switching elements; a plurality of second electrodes to each of which a source voltage is applied; and a plurality of third electrodes to each of which a common voltage is applied, the third electrodes being arranged so that a liquid crystal layer is interposed between the third electrodes and the pixel electrodes. The source voltage includes a voltage corresponding to an image signal and another voltage corresponding to an assist signal. The method includes the steps of: applying the common voltage during an image signal writing scanning period which is defined as a period during which the voltage corresponding to the image signal is applied; and applying the common voltage during at least one assist signal writing scanning period which is defined as a period during which the voltage corresponding to the assist signal is applied. The common voltage has different values between the image signal writing scanning period and the at least one assist signal writing scanning period.

In one embodiment of the invention, a liquid crystal capacitor is provided between one of the pixel electrodes and one of the third electrodes.

In one embodiment of the invention, a liquid crystal capacitor is provided between one of the pixel electrodes and one of the second electrodes.

In one embodiment of the invention, a range of a voltage applied to the liquid crystal capacitor during each assist signal writing scanning period is greater than a range of a voltage applied to the liquid crystal capacitor during the image signal writing scanning period.

In one embodiment of the invention, a range of a voltage applied to the liquid crystal capacitor during each assist signal writing scanning period is greater than a range of a voltage applied to the liquid crystal capacitor during the image signal writing scanning period.

In one embodiment of the invention, the source voltage applied during the assist signal writing scanning period includes a voltage for producing a black display or a white display.

In one embodiment of the invention, the source voltage applied during the assist signal writing scanning period includes a maximum voltage or a minimum voltage which can be output by a source voltage generation circuit for generating the source voltage.

In one embodiment of the invention, one field period includes at least two subfield periods including the image signal writing scanning period and the assist signal writing scanning period. A voltage corresponding to an image signal for a predetermined color component for each of the subfield periods is applied as the source voltage during the image signal writing scanning period.

In one embodiment of the invention, the one field period includes: a subfield period for displaying a red component; a subfield period for displaying a green component; and a subfield period for displaying a blue component.

According to still another aspect of this invention, there is provided a method for driving a liquid crystal display device. The liquid crystal display device includes: a plurality of first electrodes; a plurality of second electrodes crossing the first electrodes; a plurality of switching elements each provided in a vicinity of an intersection of the first electrode and the second electrode; a plurality of pixel electrodes respectively provided in a plurality of regions which are arranged in a matrix and partitioned from one another by the first electrodes and the second electrodes; a plurality of first electrodes to each of which a gate voltage is applied for turning ON/OFF each of the switching elements; a plurality of second electrodes to each of which a source voltage is applied; and a plurality of third electrodes to each of which a common voltage is applied, the third electrodes being arranged so that a liquid crystal layer is interposed between the third electrodes and the pixel electrodes. The liquid crystal display device further includes a plurality of assist electrodes to each of which an assist voltage is applied, the assist electrode having an assist capacitor being provided between each of the pixel electrodes and the assist electrode. The method includes the steps of: applying a voltage corresponding to an image signal is applied between the pixel electrode and the third electrode during an image signal application period; and applying a voltage corresponding to an assist signal is applied between the pixel electrode and the third electrode during an assist signal application period. At least one of the common voltage and the assist voltage has different values between the image signal application period and the assist signal application period.

In one embodiment of the invention, a plurality of rows of assist electrodes receive alternately different signals.

In one embodiment of the invention, a voltage which takes two or more levels is applied during the assist signal application period to one of at least one of the third electrodes and at least one of the assist electrodes.

In one embodiment of the invention, a write period is provided during which a voltage corresponding to an image signal is applied to the pixel electrodes via the switching elements. A first assist signal application period including the write period and a second assist signal application period not including the write period are provided. A polarity of a voltage between the pixel electrodes and the third electrodes is reversed with respect to a polarity of a voltage applied during the image signal application period between the write period and the second assist signal application period.

In one embodiment of the invention, the voltage for the assist signal application period is simultaneously applied to a plurality of pixels.

In one embodiment of the invention, the assist signal application period is coordinated with a timing at which the voltage corresponding to the image signal is applied to each of the pixel electrodes.

In one embodiment of the invention, a voltage exceeding a voltage range to be applied during the image signal application period is applied between the pixel electrodes and the third electrodes during the assist signal application period.

In one embodiment of the invention, one field period includes at least two subfield periods including the image signal application period and the assist signal application period. A voltage corresponding to an image signal for a predetermined color component for each of the subfield periods is applied between the pixel electrodes and the third electrodes during the image signal application period.

In one embodiment of the invention, the one field period includes: a subfield period for displaying a red component; a subfield period for displaying a green component; and a subfield period for displaying a blue component.

According to still another aspect of this invention, there is provided a method for driving a liquid crystal display device. The liquid crystal display device includes: a plurality of first electrodes; a plurality of second electrodes crossing the first electrodes; a plurality of switching elements each provided in a vicinity of an intersection of the first electrode and the second electrode; a plurality of pixel electrodes respectively provided in a plurality of regions which are arranged in a matrix and partitioned from one another by the first electrodes and the second electrodes; a plurality of first electrodes to each of which a gate voltage is applied for turning ON/OFF each of the switching elements; a plurality of second electrodes to each of which a source voltage is applied; and a plurality of third electrodes to each of which a common voltage is applied, the third electrodes being arranged so that a liquid crystal layer is interposed between the third electrodes and the pixel electrodes. The liquid crystal display device further includes a plurality of assist electrodes to each of which an assist voltage is applied, the assist electrode having an assist capacitor being provided between each of the pixel electrodes and each of the first electrodes. The method includes the steps of: applying a voltage corresponding to an image signal is applied between the pixel electrode and the third electrode during an image signal application period; and applying a voltage corresponding to an assist signal is applied between the pixel electrode and the third electrode during an assist signal application period. At least one of the common voltage and the assist voltage has different values between the image signal application period and the assist signal application period.

In one embodiment of the invention, a voltage which takes two or more levels is applied during the assist signal application period to one of at least one of the third electrodes and at least one of the first electrodes.

In one embodiment of the invention, a write period is provided during which a voltage corresponding to an image signal is applied to the pixel electrodes via the switching elements. A first assist signal application period including the write period and a second assist signal application period not including the write period are provided. A polarity of a voltage between the pixel electrodes and the third electrodes is reversed with respect to a polarity of a voltage applied during the image signal application period between the write period and the second assist signal application period.

In one embodiment of the invention, the voltage for the assist signal application period is simultaneously applied to a plurality of pixels.

In one embodiment of the invention, the assist signal application period is coordinated with a timing at which the voltage corresponding to the image signal is applied to each of the pixel electrodes.

In one embodiment of the invention, a voltage exceeding a voltage range to be applied during the image signal application period is applied between the pixel electrodes and the third electrodes during the assist signal application period.

In one embodiment of the invention, one field period includes at least two subfield periods including the image signal application period and the assist signal application period. A voltage corresponding to an image signal for a predetermined color component for each of the subfield periods is applied between the pixel electrodes and the third electrodes during the image signal application period.

In one embodiment of the invention, the one field period includes: a subfield period for displaying a red component; a subfield period for displaying a green component; and a subfield period for displaying a blue component.

Thus, the invention described herein makes possible the advantages of: (1) providing a liquid crystal display device in which it is possible to increase the liquid crystal response speed, prevent a motion picture from being blurred or having an after-image, improve the color reproducibility in the field sequential color method, and reduce the production cost and the power consumption; and (2) providing a method for driving such a liquid crystal display device.

These and other advantages of the present invention will become apparent to those skilled in the art upon reading and understanding the following detailed description with reference to the accompanying figures.

DESCRIPTION OF THE PREFERRED EMBODIMENTS

Various embodiments of the present invention will now be described with reference to the accompanying drawings.

Embodiment 1

Figure 1:
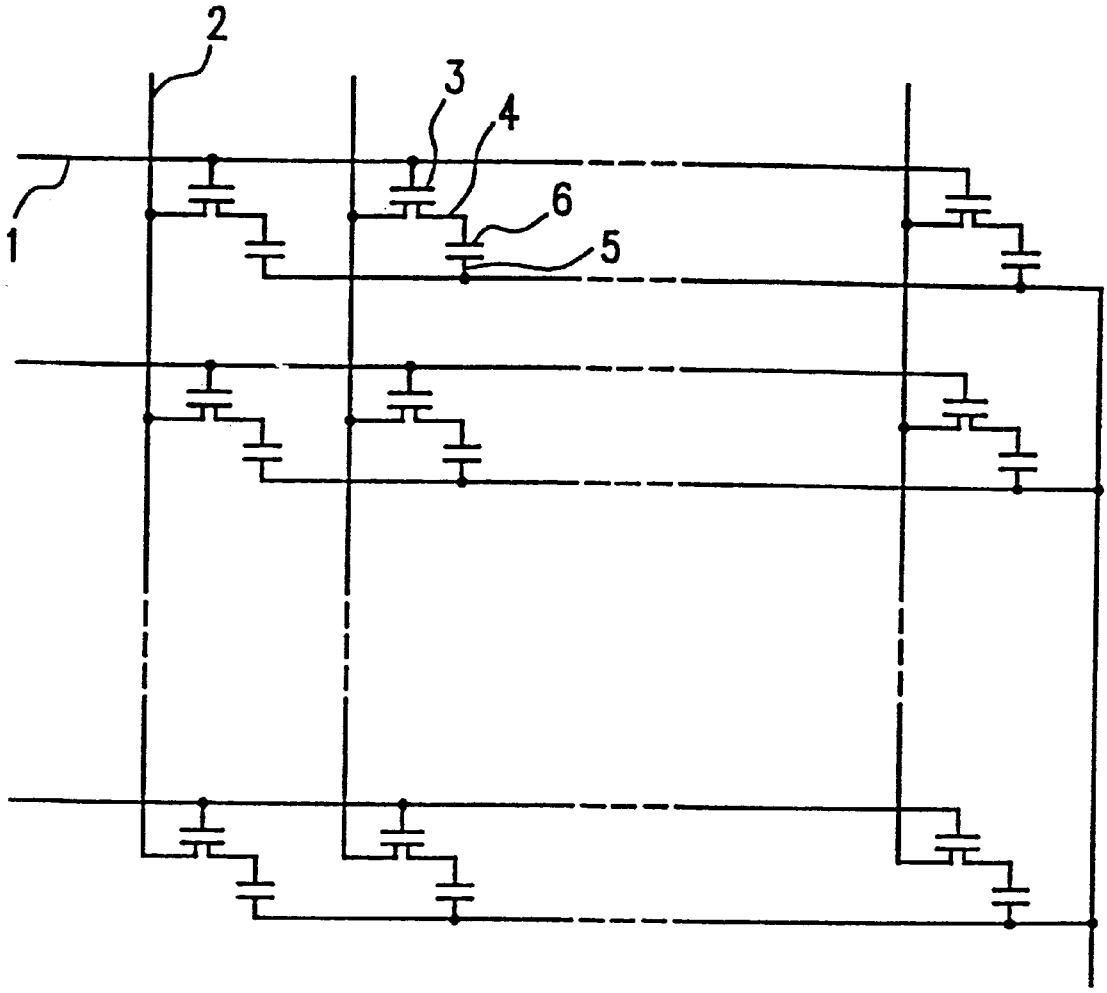
FIG. 1 illustrates an equivalent circuit diagram of a liquid crystal display device according to Embodiment 1 of the present invention.

FIG. 1 illustrates an equivalent circuit diagram of a liquid crystal display device according to Embodiment 1 of the present invention.

The liquid crystal display device includes a plurality of gate electrodes 1 and a plurality of source electrodes 2 crossing the gate electrodes 1. A thin film transistor as a switching element 3 is provided in the vicinity of each intersection of the gate electrode 1 and the source electrode 2. The display area is divided into a plurality of pixel regions arranged in a matrix, which are partitioned from one another by the gate electrodes 1 and the source electrodes 2. A pixel electrode 4 is provided in each of the pixel regions. The pixel electrode 4 is connected to the source electrode 2 via the switching element 3. A liquid crystal layer (not shown) is interposed between the pixel electrode 4 and a common electrode 5. A liquid crystal capacitor 6 is provided between the pixel electrode 4 and the common electrode 5.

Figure 2:
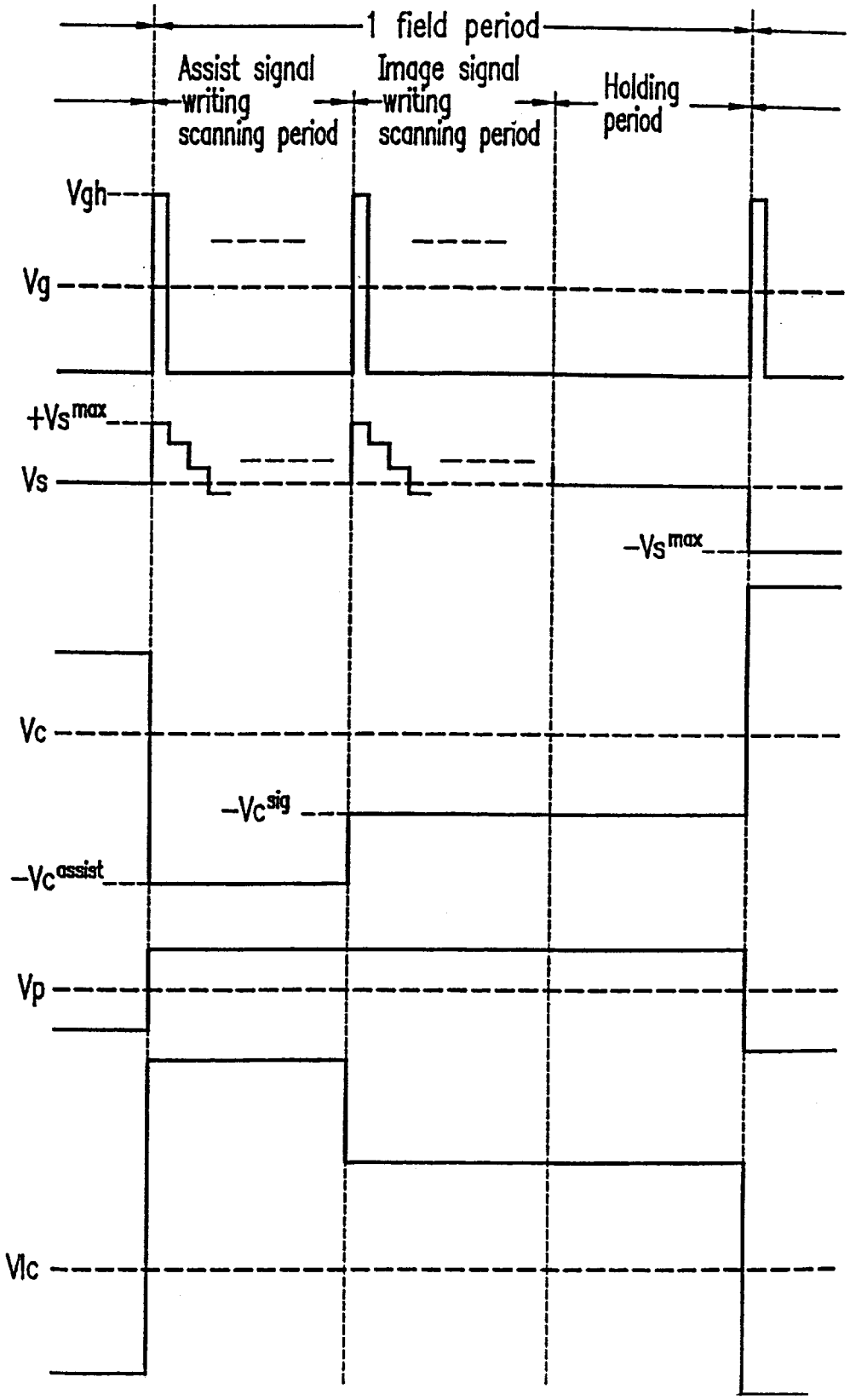
FIG. 2 illustrates voltage waveforms used for driving the liquid crystal display device according to Embodiment 1 of the present invention.

FIG. 2 illustrates voltage waveforms used for driving the liquid crystal display device.

Each field period includes an assist signal writing scanning period, an image signal writing scanning period, and a holding period.

A pulse waveform of ON voltage Vgh for turning ON the switching element 3 is applied as a gate voltage Vg to the gate electrodes 1. A plurality of such pulses are sequentially applied.

A voltage corresponding to an image signal for the row for which the ON voltage Vgh is being input to the gate electrode 1 is applied as a source voltage Vs to the source electrode 2 during the assist signal writing scanning period and the image signal writing scanning period. A plurality of such image signals are applied sequentially. In Embodiment 1, the source voltage for the assist signal writing scanning period and that for the image signal writing scanning period are set to be equal to each other.

A common voltage Vc is applied to the common electrode 5. The common voltage Vc has an amplitude of $\pm Vc^{assist}$ during the assist signal writing scanning period, and $\pm Vc^{sig}$ during the image signal writing scanning period. While the polarity of the common voltage is inverted after each field in Embodiment 1, the polarity of common voltage may alternatively be inverted after each horizontal scanning period.

Each time the ON voltage Vgh is applied to the gate electrode 1, a new source voltage Vs is applied to the pixel electrode 4 as a pixel voltage Vp.

As a result, a liquid crystal voltage Vlc, which is equal to the difference between the pixel voltage Vp and the common voltage Vc, is applied through the liquid crystal layer.

Figure 3:
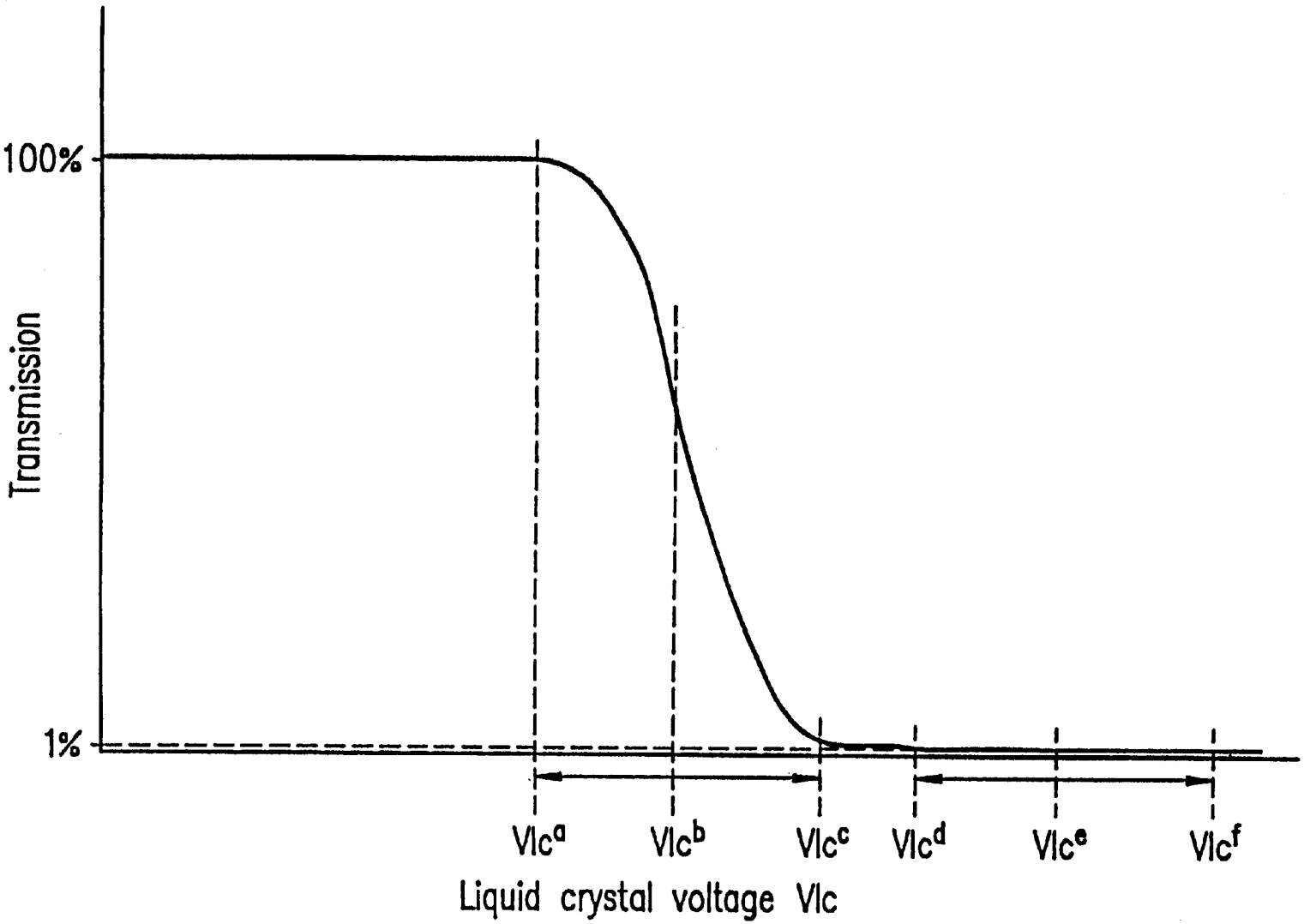
FIG. 3 illustrates the relationship between a liquid crystal voltage Vlc and a transmission for the liquid crystal display device according to Embodiment 1 of the present invention.

FIG. 3 illustrates the relationship between the liquid crystal voltage Vlc and the transmission. In this example, a TN type normally white mode is used.

The output range $\pm Vs^{max}$ of the source voltage Vs is normally set to the voltage difference between a voltage $Vlc^a$ at which the 100% transmission is obtained and a voltage $Vlc^c$ at which about 1% transmission is obtained. Thus, the out put range of the source voltage Vs is set to a minimum range required to obtain a practically sufficient contrast. When the output range of the source voltage Vs is set to be higher than this, a source driver having a high voltage resistance is required, thereby increasing the cost of the device.

In Embodiment 1, the liquid crystal voltage Vlc, the source voltage Vs and the common voltage Vc are set to satisfy the relationship as shown in the following Expression 2.

$$Vlc^a=|+Vs^{max}\pm Vc^{sig}|$$

$$Vlc^b=|+Vc^{sig}|$$

$$Vlc^c=|+Vs^{max}\pm Vc^{sig}|$$

$$Vlc^d=|+Vs^{max}\pm Vc^{assist}|$$

$$Vlc^e=|+Vc^{assist}|$$

$$Vlc^f=|+Vs^{max}\pm Vc^{assist}| \qquad \text{Expression 2}$$

In the conventional driving methods described in the background section, only a voltage in the range of $Vlc^a$ to $Vlc^c$ can be applied through the liquid crystal layer during the assist signal writing scanning period. In Embodiment 1, on the contrary, a voltage exceeding the range of $Vlc^a$ to $Vlc^c$ can easily be applied by appropriately setting the amplitude $\pm Vc^{assist}$.

Thus, a liquid crystal voltage Vlc which is greater than the voltage applied during an image signal writing scanning period by a constant voltage difference can be applied during the assist signal writing scanning period. Therefore, it is possible to set an effective assist signal for each image signal.

Next, the change in the transmission through the liquid crystal layer according to Embodiment 1 will be described with reference to FIG. 4. While the timing at which the liquid crystal molecules respond to an applied voltage shifts (varies) for different rows, FIG. 4 illustrates an exemplary change in the transmission for the pixels in the first row, among all the pixels which are scanned during a single scanning operation, when an image signal for a white display and another image signal for a gray-level display are alternately displayed.

Figure 4:
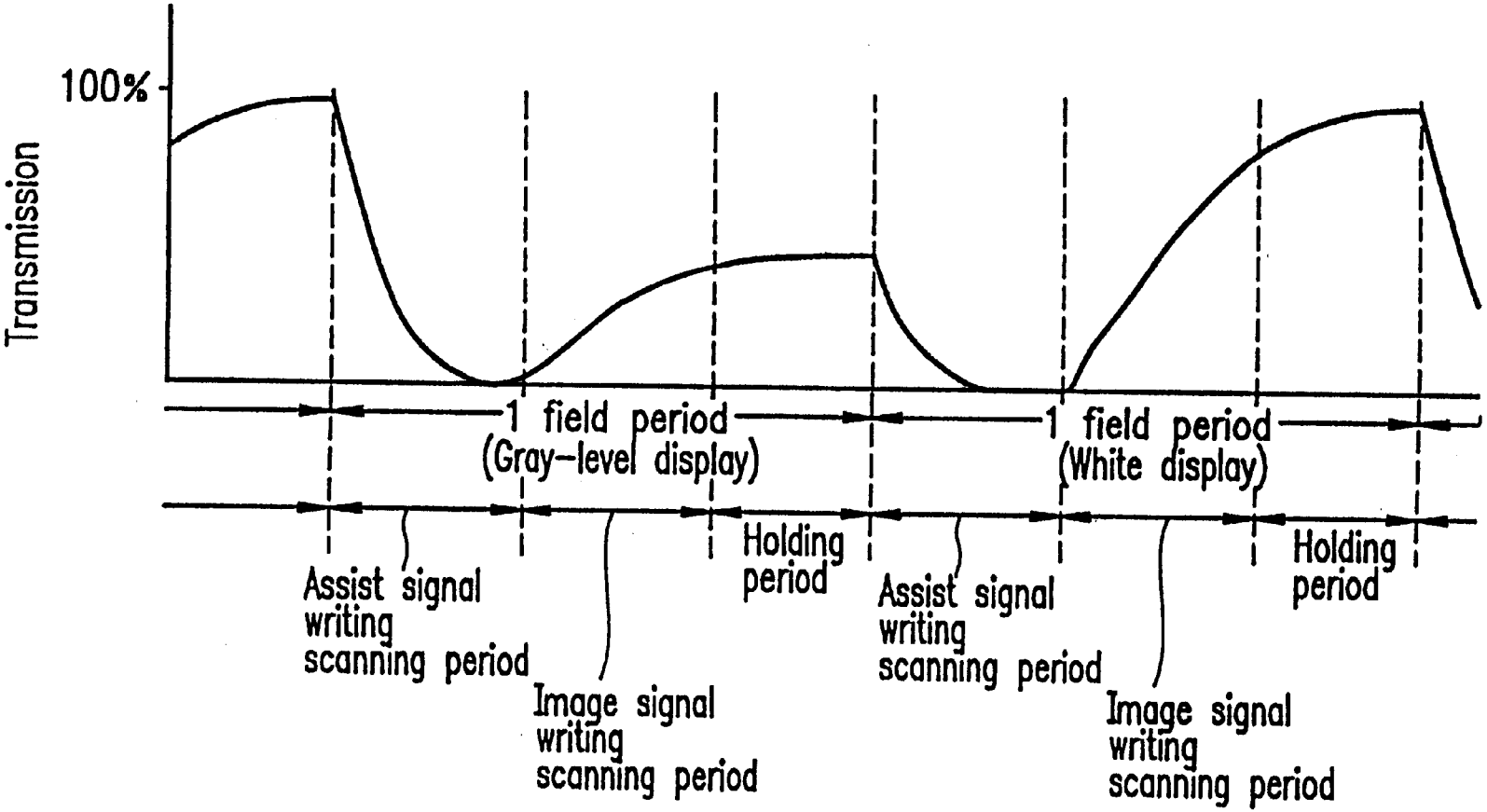
FIG. 4 illustrates a change in the transmission of the liquid crystal display device according to Embodiment 1 of the present invention.

As illustrated in FIG. 4, for each of the "white →gray-level" transition and the "gray-level→white" transition, the transmission reaches the black display level before the end of the assist signal writing scanning period, and the transmission reaches an appropriate level according to the white or gray-level image signal during the image signal writing scanning period and the holding period. Thus, before each operation of writing an image signal, the liquid crystal capacitance is set to a constant level corresponding to a black display, thereby preventing the image signal write operation from being influenced by the previously written image signal.

According to Embodiment 1 of the present invention, it is possible to reduce the liquid crystal response time (i.e., the amount of time required for the liquid crystal molecules to respond to the applied voltage) by writing an assist signal which is determined according to each image signal. Therefore, it is possible to shorten the period of time from the assist signal writing scanning period to the image signal writing scanning period, thereby increasing the period of time during which the image signal is written and thus obtaining a bright display.

Moreover, a black display transmission is reached during a short period of time after each assist signal writing scanning period irrespective of the image signal which has been written in the pixel electrode during the previous field, whereby it is possible to prevent a motion picture from being blurred or having an after-image due to the influence from the image signal which has been written during the previous field and thus to obtain a bright display. Moreover, it is possible to use a source driver with a voltage resistance comparable to that of a conventional source driver can be used, thereby avoiding an increase in the production cost.

The settings of the common voltage $Vc^{assist}$ for the assist signal writing scanning period and the common voltage $Vc^{sig}$ for the image signal writing scanning period are not limited to that shown in Embodiment 1. The response time required for the transition to a black display during the assist signal writing scanning period can be shortened by setting the voltage difference between $Vc^{assist}$ and $Vc^{sig}$ to a large value. However, when the voltage difference is excessively large, the transition from the black display to a display according to the image signal may be slow. Thus, the period of time from the assist signal writing scanning period to the image signal writing scanning period can be effectively shortened by optimizing the voltage difference in view of the response performance of the liquid crystal material to be used.

The settings of the source voltage Vs and the common voltage Vc for the assist signal writing scanning period are also not limited to that shown in Embodiment 1. The source voltage Vs for the assist signal writing scanning period may be set to a voltage different from that for the image signal writing scanning period. For example, a voltage for a black display or a white display may be used as the source voltage Vs for the assist signal writing scanning period. Moreover, it is possible to provide a plurality of assist signal writing scanning periods.

When a white display signal is used as the assist signal, the back light may be turned OFF during the period in which a display corresponding to the assist signal is produced.

While the assist signal writing scanning period and the image signal writing scanning period are sequentially provided in Embodiment 1, the present invention is not limited to this. Alternatively, the assist signal writing scanning period and the image signal writing scanning period may be provided alternately for every row or every two or more rows, for example.

The liquid crystal mode may be a mode other than a TN mode, and a normally black mode may be employed instead of a normally white mode.

In Embodiment 1, an additional capacitor is not provided for each pixel. Alternatively, an additional capacitor electrode may be arranged so as to provide an additional capacitor between the pixel electrode and the additional capacitor electrode. A common voltage or a voltage which varies according to the change in the common voltage may be applied to the additional capacitor electrode.

Embodiment 2

In Embodiment 2, an example in which the present invention is applied to a liquid crystal display device based on the field sequential color method is described.

Figure 5:
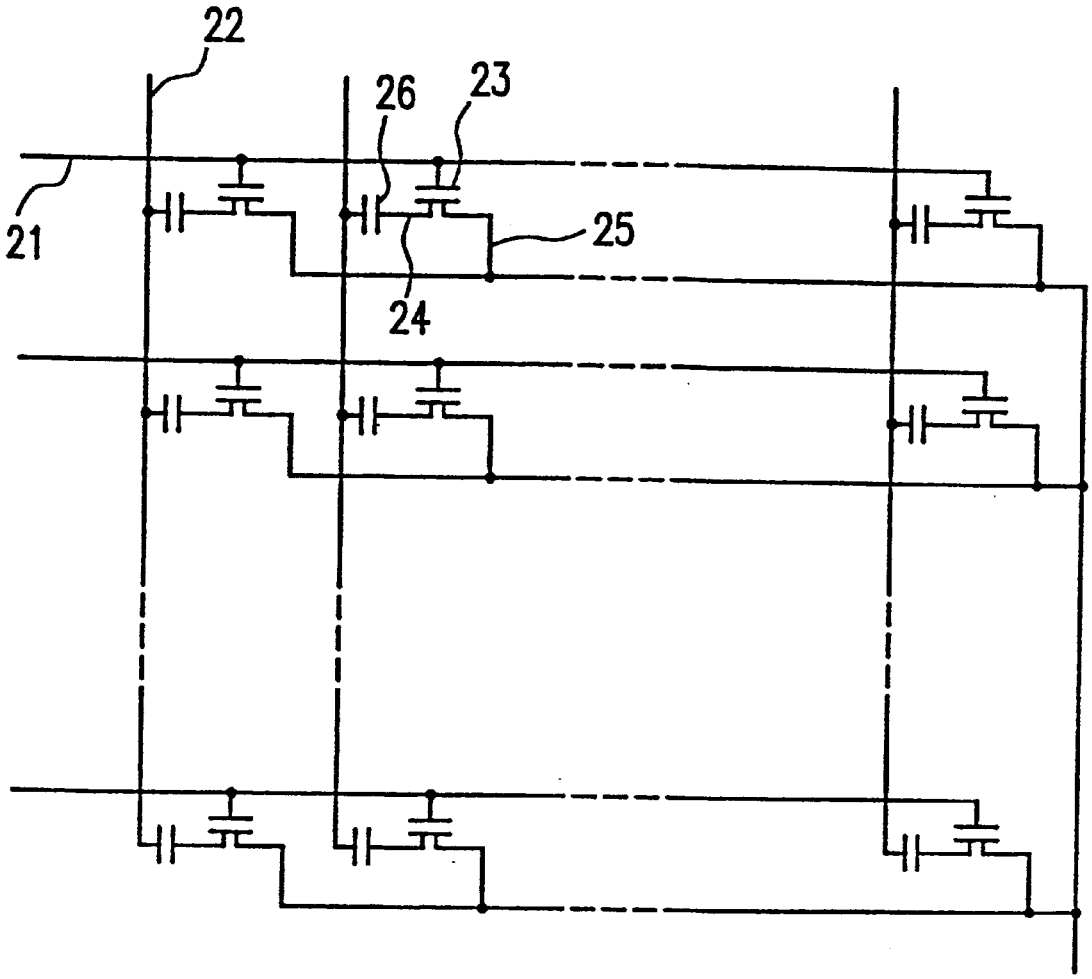
FIG. 5 illustrates an equivalent circuit diagram of a liquid crystal display device according to Embodiment 2 of the present invention.

FIG. 5 illustrates an equivalent circuit diagram of a liquid crystal display device according to Embodiment 2 of the present invention.

The liquid crystal display device includes a plurality of gate electrodes 21 and a plurality of source electrodes 22 crossing the gate electrodes 21. A thin film transistor as a switching element 23 is provided in the vicinity of each intersection of the gate electrode 21 and the source electrode 22. The display area is divided into a plurality of pixel regions arranged in a matrix, which are partitioned from one another by the gate electrodes 21 and the source electrodes 22. A pixel electrode 24 is provided in each of the pixel regions. The pixel electrode 24 is connected to the source electrode 22 via the switching element 23. A liquid crystal layer (not shown) is interposed between the pixel electrode 24 and a common electrode 25. A liquid crystal capacitor 26 is provided between the pixel electrode 24 and the common electrode 25.

In the operation of the liquid crystal display device of Embodiment 2, one field period includes a subfield period for a red component display, a subfield period for a green component and a subfield period for a blue component display. The liquid crystal display device of Embodiment 2 provides a full color display by superimposing the images displayed during the respective subfield periods on one another. Each subfield period includes an assist signal writing scanning period, an image signal writing scanning period, and a holding period.

The driving voltage waveform for each subfield period corresponds to that for each field period in the example shown in FIG. 2.

A pulse waveform of ON voltage Vgh for turning ON the switching element 23 is applied as a gate voltage Vg to the gate electrodes 21. A plurality of such pulses are sequentially applied.

A voltage corresponding to an image signal for the row for which the ON voltage Vgh is being input to the gate electrode 21 is applied as a source voltage Vs to the source electrode 22 during the assist signal writing scanning period and the image signal writing scanning period. A plurality of such image signals are applied sequentially.

A common voltage Vc is applied to the common electrode 25. The common voltage Vc has an amplitude of $\pm Vc^{assist}$ during the assist signal writing scanning period, and $\pm Vc^{sig}$ during the image signal writing scanning period.

Each time the ON voltage Vgh is applied to the gate electrode 21, a new source voltage Vs is applied to the pixel electrode 24 as a pixel voltage Vp.

As a result, a liquid crystal voltage Vlc, which is equal to the difference between the pixel voltage Vp and the common voltage Vc, is applied through the liquid crystal layer.

Figure 6:
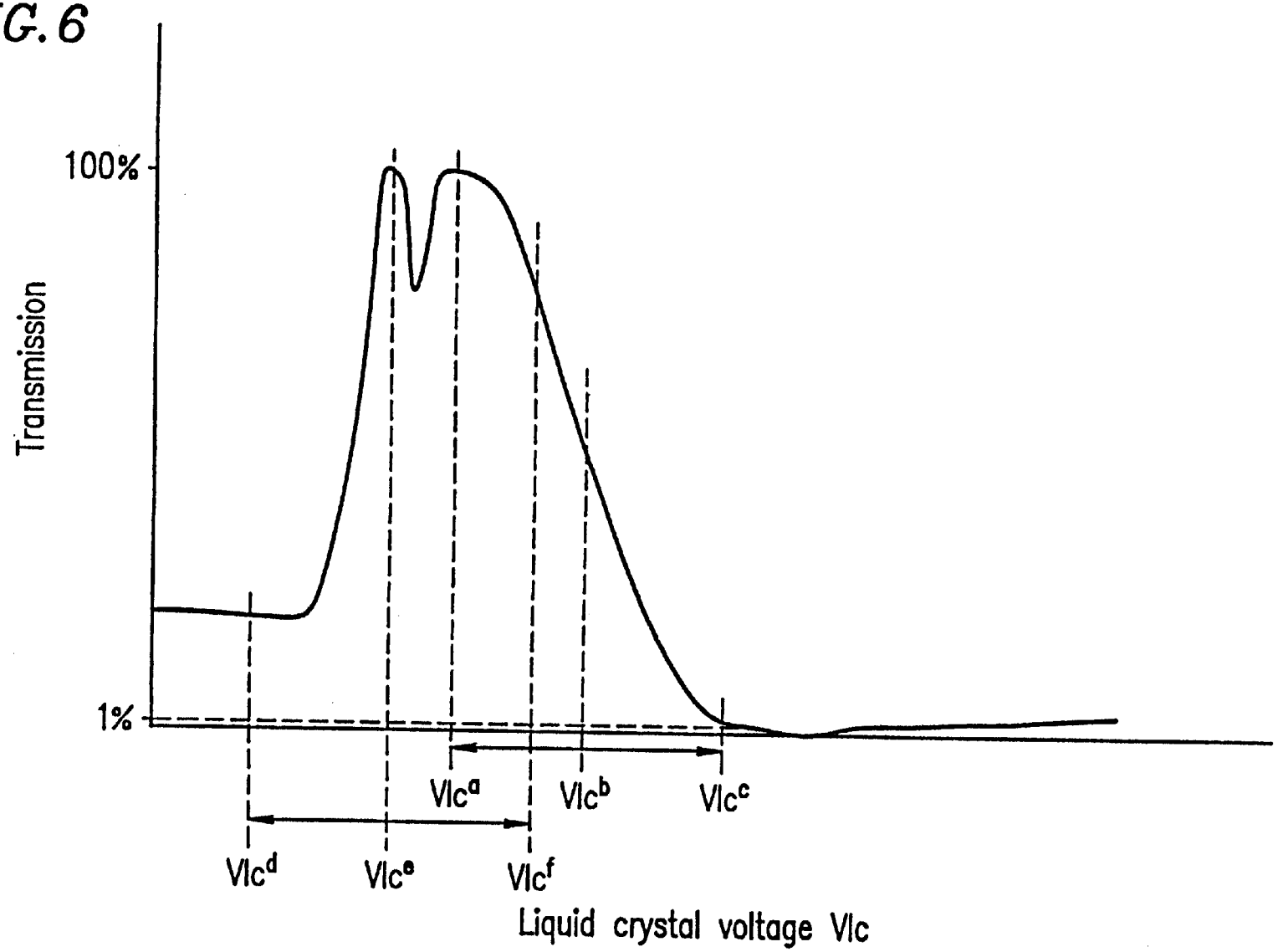
FIG. 6 illustrates the relationship between a liquid crystal voltage Vlc and a transmission for the liquid crystal display device according to Embodiment 2 of the present invention.

FIG. 6 illustrates the relationship between the liquid crystal voltage Vlc applied through the liquid crystal layer and the transmission. In this example, an OCB (optically compensated bend) type normally white mode is used as a liquid crystal display mode.

The output range $\pm Vs^{max}$ of the source voltage Vs is normally set to the voltage difference between a voltage $Vlc^a$ at which the 100% transmission is obtained and a voltage $Vlc^c$ at which about 1% transmission is obtained. Thus, the output range of the source voltage Vs is set to a minimum range required to obtain a practically sufficient contrast. When the output range of the source voltage Vs is set to be higher than this, a source driver having a high voltage resistance is required, thereby increasing the cost of the device.

In Embodiment 2, the liquid crystal voltage Vlc, the source voltage Vs and the common voltage Vc are set to satisfy the relationship as shown in the following Expression 3.

$$Vlc^a = |+Vs^{max} \pm Vc^{sig}|$$

$$Vlc^b = |+Vc^{sig}|$$

$$Vlc^c = |+Vs^{max} \pm Vc^{sig}|$$

$$Vlc^d = |+Vs^{max} \pm Vc^{assist}|$$

$$Vlc^e = |+Vc^{assist}|$$

$$Vlc^f = |+Vs^{max} \pm Vc^{assist}| \qquad \text{Expression 3}$$

In the above-described conventional driving methods, only a voltage in the range of $Vlc^a$ to $Vlc^c$ can be applied through the liquid crystal layer during the assist signal writing scanning period. In Embodiment 2, on the contrary, a voltage exceeding the range of $Vlc^a$ to $Vlc^c$ can easily be applied by appropriately setting the amplitude $\pm Vc^{assist}$.

Thus, a liquid crystal voltage Vlc which is greater than the voltage applied during an image signal writing scanning period by a constant voltage difference can be applied during the assist signal writing scanning period. Therefore, it is possible to set an effective assist signal for each image signal.

Figure 7:
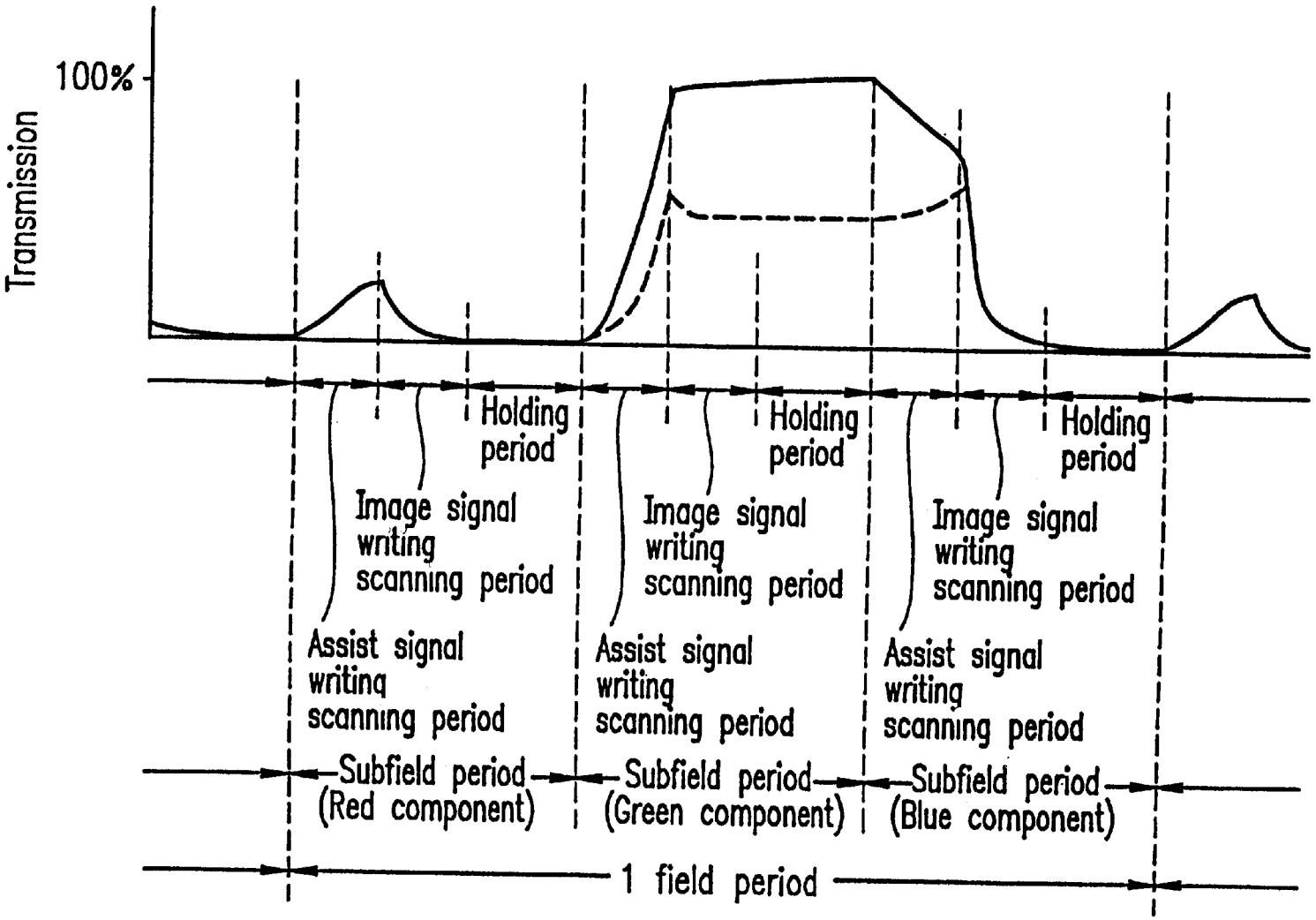
FIG. 7 illustrates a change in the transmission of the liquid crystal display device according to Embodiment 2 of the present invention.

Next, the change in the transmission through the liquid crystal layer according to Embodiment 2 will be described with reference to FIG. 7. In FIG. 7, a solid line shows the change in the transmission obtained when a voltage corresponding to an image signal for a bright green display is applied, and a broken line shows the change in the transmission obtained when a voltage corresponding to an image signal for a dark green display is applied.

As illustrated in FIG. 7, for each of the bright green display and the dark green display, a transmission corresponding to the image signal for each display color is reached within the corresponding subfield period, thereby obtaining a color display with a good reproducibility.

In Embodiment 2, the voltage for the assist signal writing scanning period is set to be lower than the voltage for the image signal writing scanning period, as illustrated in FIG. 6. This is because in the liquid crystal mode employed in Embodiment 2, the liquid crystal response is slower when the liquid crystal voltage is low than when it is high. By applying a low voltage during the assist signal writing scanning period, it is possible to selectively increase the liquid crystal response to a high-to-low voltage transition (rather than increasing the liquid crystal response to a low-to-high voltage transition).

For an image signal corresponding to a black display (such as those for the red component subfield period and the blue component subfield period when a green display is being produced), the amount of change in the transmission toward the white display following the assist signal writing scanning period can be reduced so as to avoid an unnecessary liquid crystal response, so that a transmission corresponding to the next image signal can be reached more quickly. This is possible because the liquid crystal voltage applied during the assist signal writing scanning period for an image signal corresponding to a black display is higher than that for an image signal corresponding to a white display.

Thus, according to Embodiment 2, the amount of voltage change between the image signal writing scanning period and the assist signal writing scanning period can be set an appropriate value according to the voltage of the image signal. Therefore, it is possible to effectively shorten the liquid crystal response time for any image signal. Because the liquid crystal response speed is high, the assist signal writing scanning period and/or the image signal writing scanning period can be shortened so as to prolong the holding period, thereby obtaining a bright display.

Moreover, a transmission corresponding to the image signal can be reached after the assist signal writing scanning period irrespective of the image signal which has been written in the pixel electrode during the previous field, whereby it is possible to avoid the influence of the image signal which has been written during the previous field and to obtain a display with a good color reproducibility.

Moreover, the source driver is only required to be able to output the voltage range for the image signals, and it is not necessary to increase the voltage resistance of the source driver due to the use of the assist voltage, thereby avoiding an increase in the production cost.

The settings of the common voltage $Vc^{assist}$ for the assist signal writing scanning period and the common voltage $Vc^{sig}$ for the image signal writing scanning period are not limited to that shown in Embodiment 2. The values of $Vc^{assist}$ and $Vc^{sig}$ may be appropriately set in view of the response performance of the liquid crystal material to be used.

The settings of the source voltage Vs and the common voltage Vc for the assist signal writing scanning period are also not limited to that shown in Embodiment 2. The values of Vs and Vc may be appropriately set for each of the gray-scale levels to be provided for the image signals. Moreover, it is possible to provide a plurality of assist signal writing scanning periods.

While the assist signal writing scanning period and the image signal writing scanning period are sequentially provided in Embodiment 2, the present invention is not limited to this. Alternatively, the assist signal writing scanning period and the image signal writing scanning period may be provided alternately for every or every two or more rows, for example.

The liquid crystal mode may be a mode other than an OCB mode, and a normally black mode may be employed instead of a normally white mode.

In Embodiment 2 again, an additional capacitor is not provided for each pixel. Alternatively, an additional capacitor electrode may be arranged so as to provide an additional capacitor between the pixel electrode and the additional capacitor electrode. A common voltage or a voltage which varies according to the change in the common voltage may be applied to the additional capacitor electrode. Moreover, the pixel electrodes and/or the counter electrodes may alternatively be arranged in a comb-like pattern.

Embodiment 3

Figure 8:
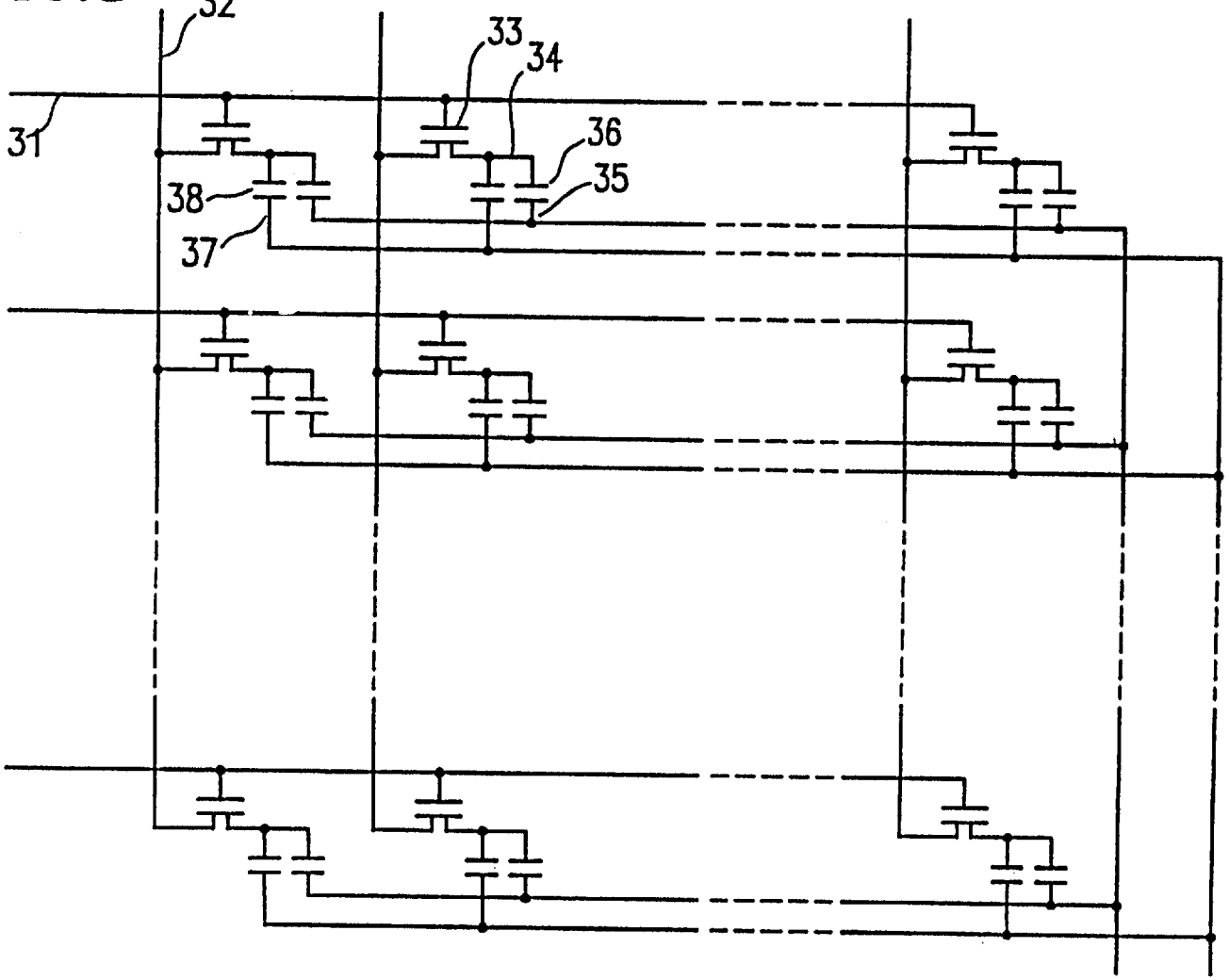
FIG. 8 illustrates an equivalent circuit diagram of a liquid crystal display device according to Embodiment 3 of the present invention.

FIG. 8 illustrates an equivalent circuit diagram of a liquid crystal display device according to Embodiment 3 of the present invention.

The liquid crystal display device includes a plurality of gate electrodes 31 and a plurality of source electrodes 32 crossing the gate electrodes 31. A thin film transistor as a switching element 33 is provided in the vicinity of each intersection of the gate electrode 31 and the source electrode 32. The display area is divided into a plurality of pixel regions arranged in a matrix, which are partitioned from one another by the gate electrodes 31 and the source electrodes 32. A pixel electrode 34 is provided in each of the pixel regions. The pixel electrode 34 is connected to the source electrode 32 via the switching element 33. A liquid crystal layer (not shown) is interposed between the pixel electrode 34 and a common electrode 35. A liquid crystal capacitor 36 is provided between the pixel electrode 34 and the common electrode 35. Moreover, an assist capacitor 38 is provided between the pixel electrode 34 and an assist electrode 37 in parallel to the liquid crystal capacitor 36.

Figure 9:
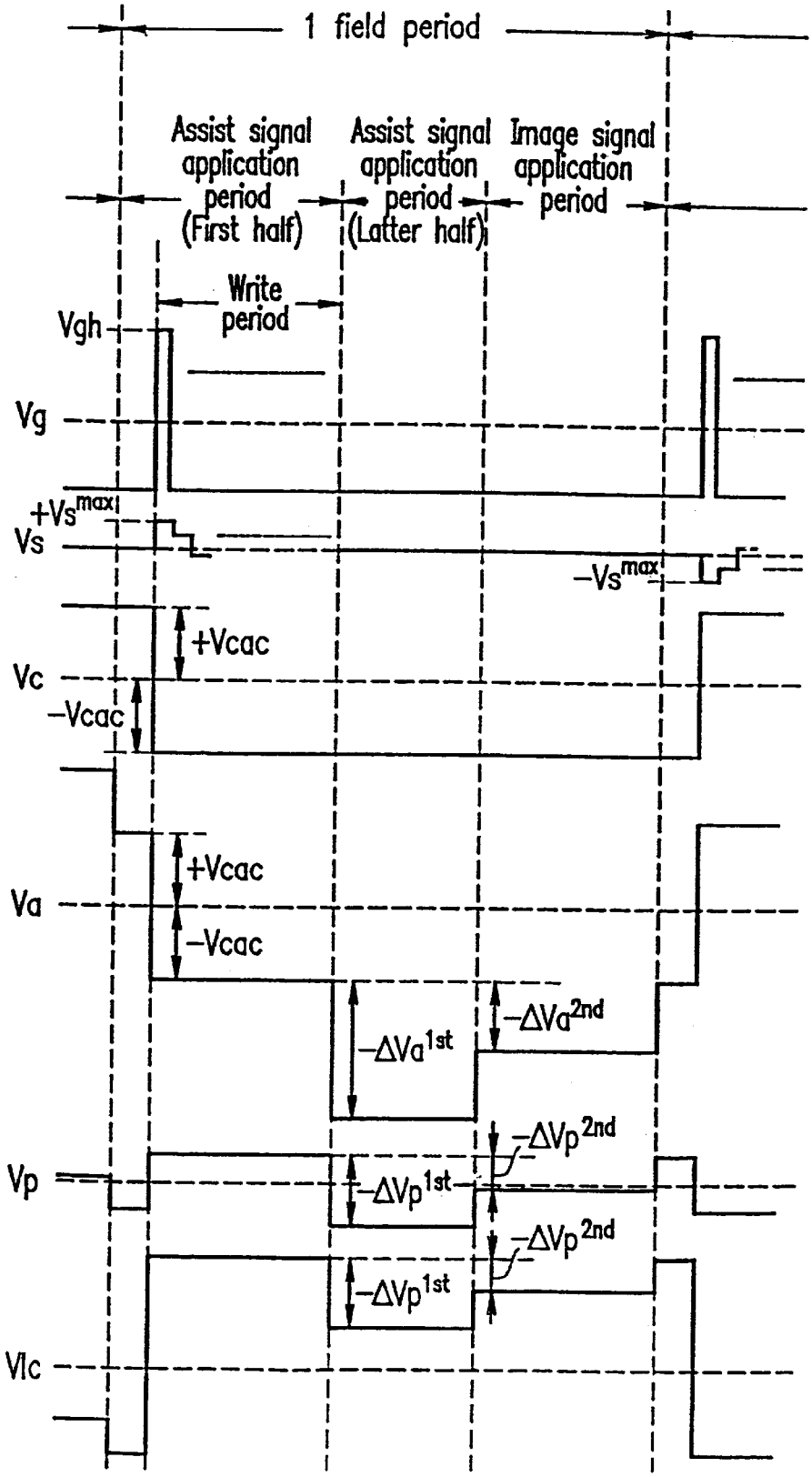
FIG. 9 illustrates voltage waveforms used for driving the liquid crystal display device according to Embodiment 3 of the present invention.

FIG. 9 illustrates voltage waveforms used for driving the liquid crystal display device.

One field period includes an assist signal application period and an image signal application period. The assist signal application period includes a write period for writing an image signal to the pixel electrode 34 via the switching element 33.

A pulse waveform of ON voltage Vgh for turning ON the switching element 33 is applied as a gate voltage Vg to the gate electrodes 31. A plurality of such pulses are sequentially applied.

A voltage corresponding to an image signal for the row for which the ON voltage Vgh is being input to the gate electrode 31 during the write period is applied as a source voltage Vs to the source electrode 32. A plurality of such image signals are applied sequentially.

The common voltage Vc to be applied to the common electrode 35 is a rectangular wave having an amplitude of ±Vcac.

As the assist voltage Va to be applied to the assist electrode 37, a voltage of ±Vcac (as for the common voltage Vc) is input during the first half of the assist signal application period including the write period, and a voltage obtained by shifting ±Vcac by $\pm\Delta Va^{1st}$ according to the polarity of the common voltage Vc during the write period is input during the latter half of the assist signal application period. During the image signal application period, a voltage obtained by shifting ±Vcac by $\pm\Delta Va^{2nd}$ is input.

Each time the ON voltage Vgh is applied to the gate electrode 31, a new source voltage Vs is applied to the pixel electrode 34 as apixel voltage Vp. Thus, the pixel voltage Vp varies simultaneously as the assist voltage Va varies due to the influence of the assist capacitor 38. The amount of change ΔVp in the pixel voltage Vp is generally in accordance with the following Expression 4.

$$\pm\Delta Vp^{1st}=\pm\Delta Va^{1st}\times(Ca/(Ca+Clc))\pm\Delta Vp^{2nd}=\pm\Delta Va^{2nd}\times(Ca/(Ca+Clc))$$

Expression 4

Assist capacitance: Ca

Liquid crystal capacitance: Clc $$Vlc^a=|\mp Vs^{max}\pm Vcac|$$

$$Vlc^b=|\pm Vcac|$$

$$Vlc^c=|\pm Vs^{max}\pm Vcac|$$

$$Vlc^d=|\mp Vs^{max}\pm Vcac\mp \Delta Vp^{1st}|$$

Thus, a liquid crystal voltage Vlc, which is equal to the difference between the pixel voltage Vp and the common voltage Vc, is applied through the liquid crystal layer.

Figure 10:
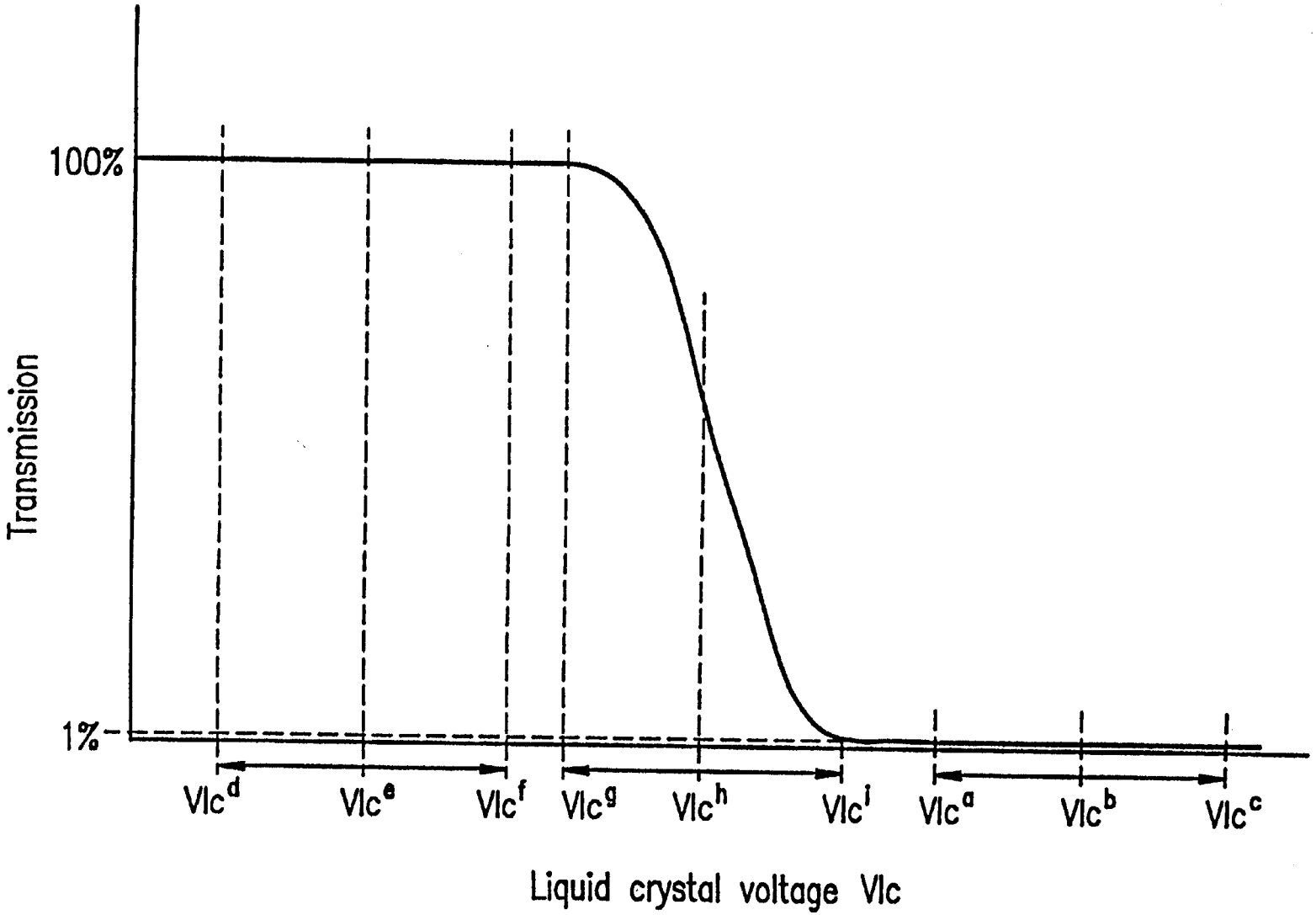
FIG. 10 illustrates the relationship between a liquid crystal voltage Vlc and a transmission for the liquid crystal display device according to Embodiment 3 of the present invention.

FIG. 10 illustrates the relationship between the liquid crystal voltage Vlc applied through the liquid crystal layer and the transmission. In this example, a TN type normally white mode (where the transmission is increased in the absence of an applied voltage) is used as a liquid crystal display mode.

The output range $\pm Vs^{max}$ of the source voltage Vs is normally set to the voltage difference between a voltage $Vlc^g$ at which the 100% transmission is obtained and a voltage $Vlc^i$ at which about 1% transmission is obtained. Thus, the output range of the source voltage Vs is set to a minimum range required to obtain a practically sufficient contrast. When the output range of the source voltage Vs is set to be higher than this, a source driver having a high voltage resistance is required, thereby increasing the cost of the device.

In Embodiment 3, the relationship among the liquid crystal voltage Vlc, the source voltage Vs, the common voltage Vc and the assist voltage Va is set as shown in the following Expression 5.

$$Vlc^e=|\pm Vcac\mp \Delta Vp^{1st}|$$

$$Vlc^f=|\pm Vs^{max}\pm Vcac\mp \Delta Vp^{1st}|$$

$$Vlc^g=|\mp Vs^{max}\pm Vcac\mp \Delta Vp^{2nd}|$$

$$Vlc^h=|\pm Vcac\mp \Delta Vp^{2nd}|$$

$$Vlc^i=|\pm Vs^{max}\pm Vcac\mp \Delta Vp^{2nd}| \qquad \text{Expression 5}$$

Therefore, even when the source voltage has a voltage corresponding to the voltage of the image signals, the liquid crystal voltage Vlc to be applied is determined in the range from $Vlc^a$ to $Vlc^c$ according to the image signal for the first half of the assist signal application period, in the range from $Vlc^d$ to $Vlc^f$ according to the image signal for the latter half of the assist signal application period, and in the range from $Vlc^g$ to $Vlc^i$ according to the image signal for the image signal application period.

Thus, the liquid crystal voltage Vlc which is obtained by adding a constant voltage difference ΔVp to the voltage corresponding to the image signal is applied during the assist signal application period, thereby setting an effective assist signal according to each image signal.

Figure 11:
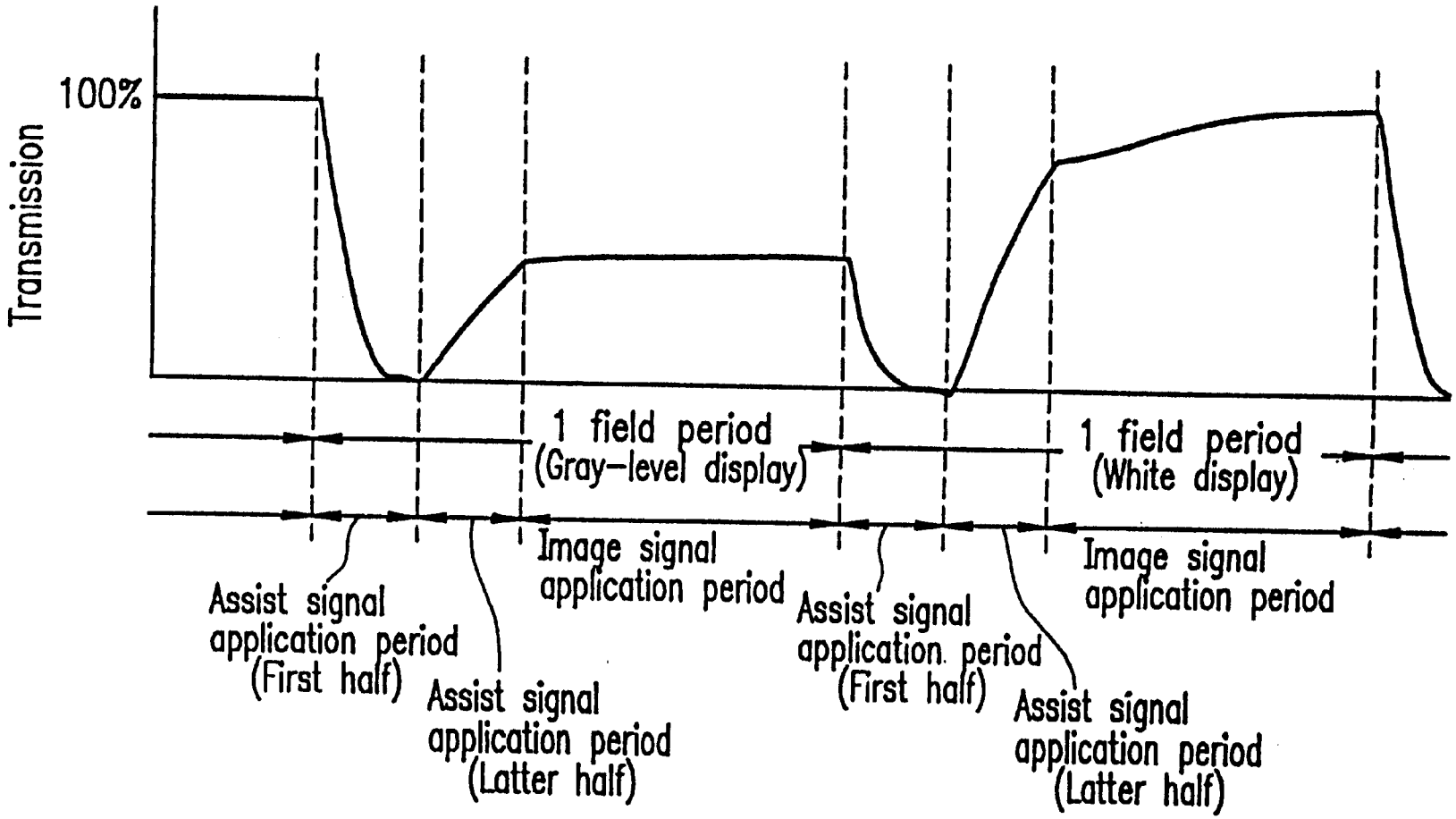
FIG. 11 illustrates a change in the transmission of the liquid crystal display device according to Embodiment 3 of the present invention.

Next, the change in the transmission through the liquid crystal layer according to Embodiment 3 will be described with reference to FIG. 11. FIG. 11 shows an exemplary change in the transmission obtained when alternately displaying a white display image signal and a black display image signal.

As illustrated in FIG. 11, for each of the "white→gray-level" transition and the "gray-level→white" transition, the transmission reaches the black display level during the first half of the assist signal application period, and the transmission shows a transitional response toward a white display during the latter half of the assist signal application period and changes to an appropriate level according to the white or gray-level image signal during the image signal application period.

Thus, each image signal can be written on a black display, whereby the image signal write operation is not influenced by the previously written image signal. Moreover, because the transitional response toward a white display is provided during the latter half of the assist signal application period, the transmission can reach an appropriate level according to the image signal during the image signal application period even for a transition to a gray-level display for which the liquid crystal response is normally slow.

In Embodiment 3, the amount of voltage change between an image signal application period and an assist signal application period is constant irrespective of the image signal, whereby it is possible to effectively reduce the liquid crystal response time for any image signal. Thus, it is possible to shorten the assist signal application period and to prolong the image signal application period during which the image is displayed, thereby obtaining a bright display.

Moreover, a black display transmission is reached during the assist signal application period irrespective of the image signal which has been written in the pixel electrode during the previous field, whereby it is possible to prevent a motion picture from being blurred or having an after-image due to the influence from the image signal which has been written during the previous field and thus to obtain a bright display. Moreover, the source driver is only required to be able to output the voltage range for the image signals, and it is not necessary to increase the maximum value of the assist voltage, thereby avoiding an increase in the production cost.

In Embodiment 3, the entire screen is switched from a black display to an image signal display simultaneously. Therefore, the light source can be controlled so that the light source is turned OFF during a period in which the entire screen is in a black display so as to improve the light efficiency and thus reduce the power consumption.

The relationship between the voltage difference ΔVp and the response speed of the liquid crystal panel will now be described. When the voltage difference $\Delta Vp^{2nd}$ is set to a relatively large value, the amount of change in the liquid crystal voltage during the first half of the assist signal application period increases, thereby reaching a black display transmission in a shorter period of time. However, when the voltage difference $\Delta Vp^{2nd}$ is excessively large, the transition from the black display to the image signal display will be slow. When the voltage difference $\Delta Vp^{1st}$ is set to a relatively large value, the amount of change in the liquid crystal voltage during the latter half of the assist signal application period increases, thereby increasing the response speed toward a white display. This is desirable particularly when the image signal is close to a white display, in which case the response speed toward the image signal display is increased. However, when the voltage difference $\Delta Vp^{1st}$ is excessively large, there will be a response toward a white display even when the image signal is a black display signal, thereby lowering the response speed to the image signal. Thus, it is possible to effectively increase the response speed of the liquid crystal panel and shorten the assist signal application period by optimizing the voltage difference ΔVp in view of the response performance of the liquid crystal material to be used.

The settings of the write period and the setting of the number of times the assist voltage changes during an assist signal application period are not limited to those shown in Embodiment 3. These settings can be appropriately adjusted in view of the response performance of the liquid crystal material to be used. While the write period is provided in the assist signal application period in Embodiment 3, it may alternatively be provided in the image signal application period. Moreover, instead of varying the assist voltage Va during the assist signal application period, the common voltage Vc may be varied during the assist signal application period.

The settings of the common voltage Vc, the assist voltage Va and the source voltage Vs are also not limited to that shown in Embodiment 3. For example, these values may be set so that the transmission is 100% during the assist signal application period. In such a case, the light source may be controlled so that the light source is turned OFF during the image signal application period.

The liquid crystal mode may be a mode other than a TN mode, and a normally black mode may be employed instead of a normally white mode.

Embodiment 4

In Embodiment 4, an example where the present invention is applied to a liquid crystal display device based on the field sequential color method is described.

Figure 12:
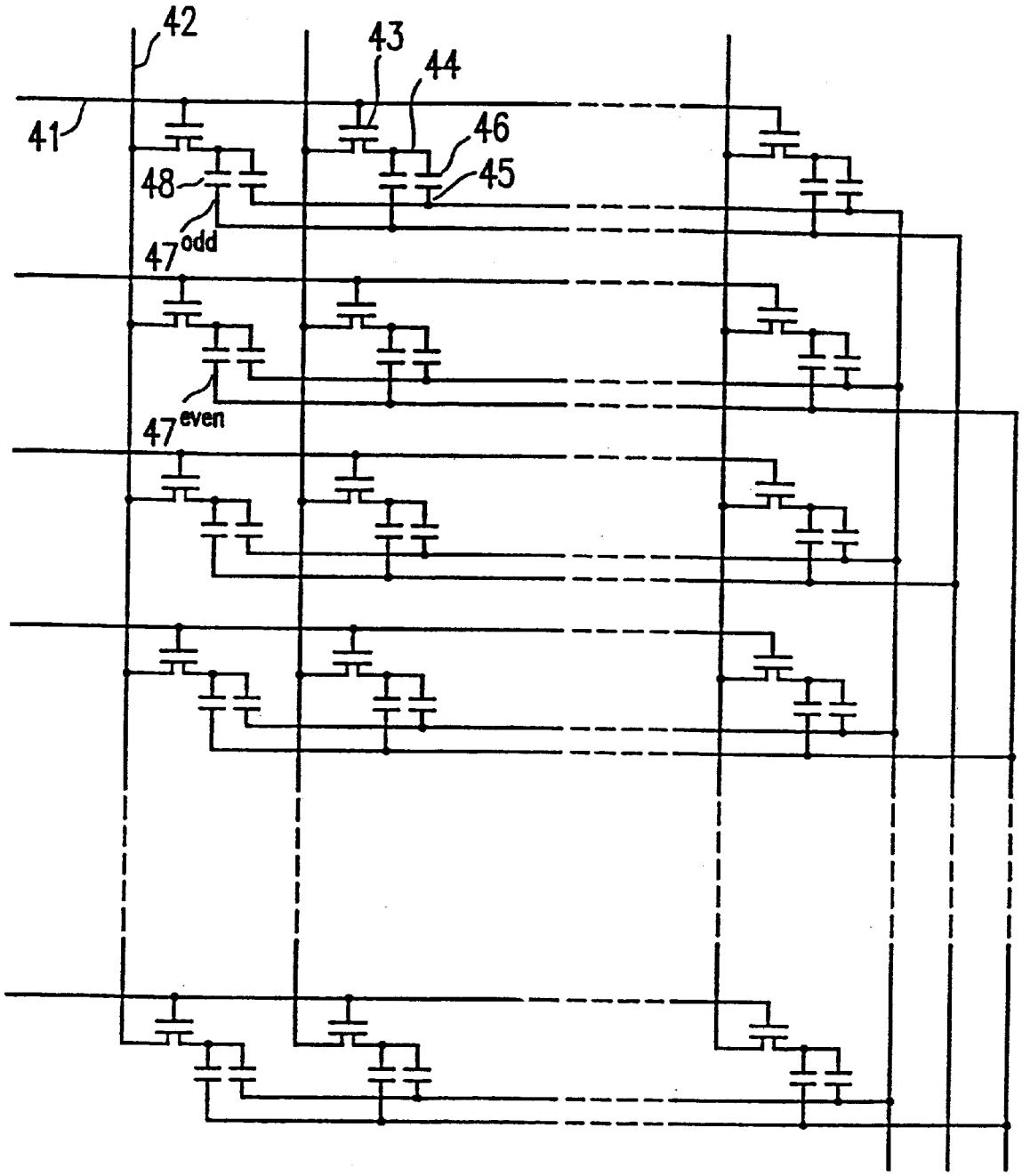
FIG. 12 illustrates an equivalent circuit diagram of a liquid crystal display device according to Embodiment 4 of the present invention.

FIG. 12 illustrates an equivalent circuit diagram of a liquid crystal display device according to Embodiment 4 of the present invention.

The liquid crystal display device includes a plurality of gate electrodes 41 and a plurality of source electrodes 42 crossing the gate electrodes 41. A thin film transistor as a switching element 43 is provided in the vicinity of each intersection of the gate electrode 41 and the source electrode 42. The display area is divided into a plurality of pixel regions arranged in a matrix, which are partitioned from one another by the gate electrodes 41 and the source electrodes 42. A pixel electrode 44 is provided in each of the pixel regions. The pixel electrode 44 is connected to the source electrode 42 via the switching element 43. A liquid crystal layer (not shown) is interposed between the pixel electrode 44 and a common electrode 45. A liquid crystal capacitor 46 is provided between the pixel electrode 44 and the common electrode 45. Moreover, an assist capacitor 48 is provided between the pixel electrode 44 and an assist electrode $\mathbf{47}^{odd}$, $\mathbf{47}^{even}$ in parallel to the liquid crystal capacitor 46. The liquid crystal display device of Embodiment 4 is structurally the same as that of Embodiment 3 except for the assist electrodes $\mathbf{47}^{odd}$ and $\mathbf{47}^{even}$ which are alternately provided for different rows and receive different signals.

Figure 13:
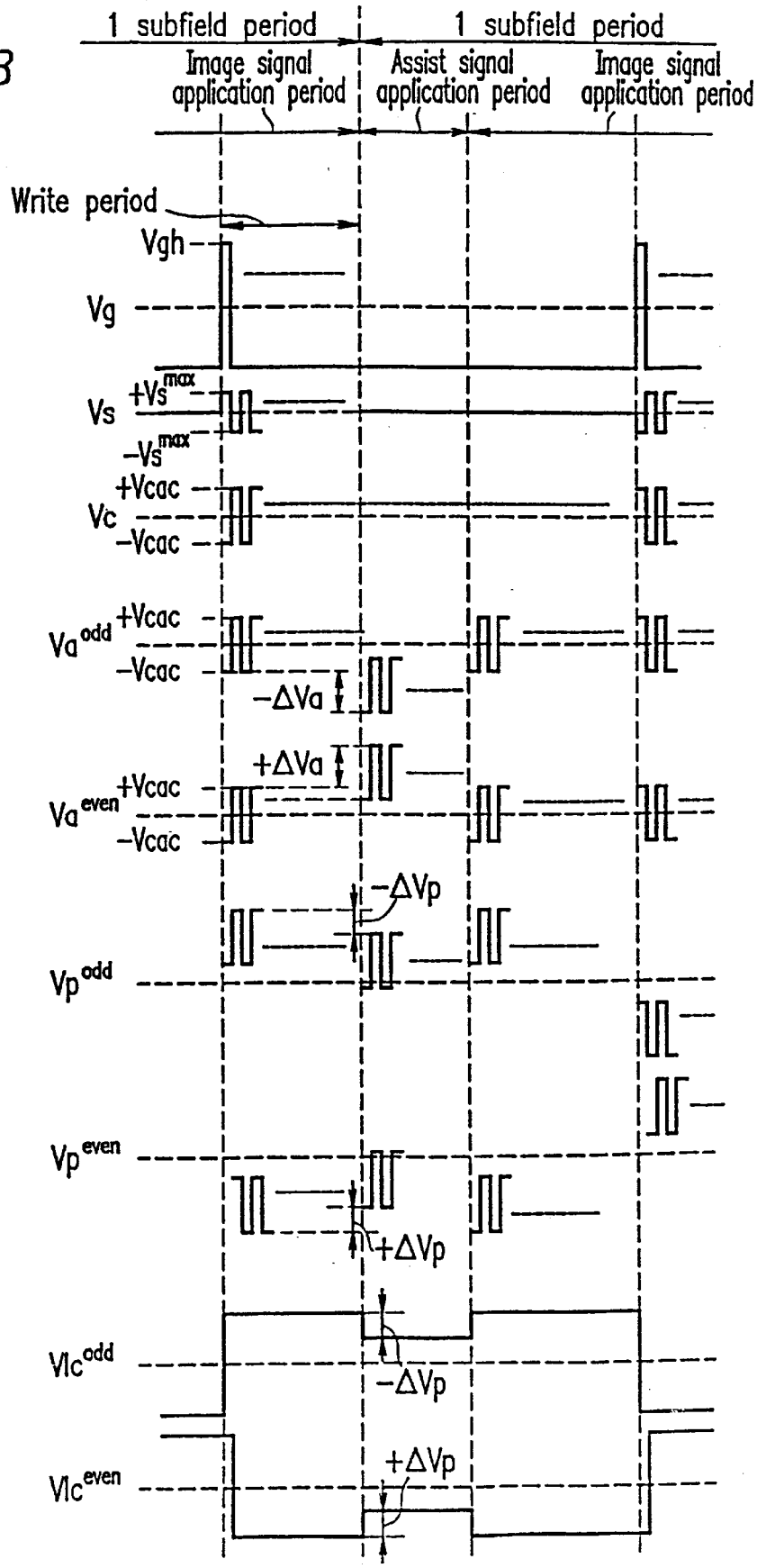
FIG. 13 illustrates voltage waveforms used for driving the liquid crystal display device according to Embodiment 4 of the present invention.

FIG. 13 illustrates voltage waveforms used for driving the liquid crystal display device.

In the operation of the liquid crystal display device of Embodiment 4, one field period includes a subfield period for a red component display, a subfield period for a green component and a subfield period for a blue component display. The liquid crystal display device of Embodiment 4 provides a full color display by superimposing the images displayed during the respective subfield periods on one another. Each subfield period includes an assist signal application period and an image signal application period. The image signal application period includes a write period for writing an image signal to the pixel electrode 44 via the switching element 43.

A pulse waveform of ON voltage Vgh for turning ON the switching element 43 is applied as a gate voltage Vg to the gate electrodes 41. A plurality of such pulses are sequentially applied.

A voltage corresponding to an image signal for the row for which the ON voltage Vgh is being input to the gate electrode 41 during the write period is applied as a source voltage Vs to the source electrode 42. A plurality of such image signals are applied sequentially. In Embodiment 4, the source voltage Vs to be applied to the source electrode 42 is a voltage whose polarity is inverted for every horizontal scanning period and every subfield period.

The common voltage Vc to be applied to the common electrode 45 is a rectangular wave having an amplitude of ±Vcac. The polarity of the common voltage Vc is inverted for every horizontal scanning period and every subfield period.

As assist voltages $Va^{odd}$ and $Va^{even}$ to be applied to the assist electrodes $\mathbf{47}^{odd}$ and $\mathbf{47}^{even}$, respectively, a voltage of ±Vcac (as for the common voltage Vc) is input during the image signal application period, and a voltage obtained by shifting ±Vcac by ±ΔVa according to the polarity of the common voltage Vc during the write period is input during the assist signal application period. Because the polarity of the common voltage Vc during the write period is inverted for every row, the polarity of the shift voltage ±ΔVa is opposite between the assist voltages $Va^{odd}$ and $Va^{even}$.

Each time the ON voltage Vgh is applied to the gate electrode 41, a new source voltage Vs is applied to the pixel electrode 44 as a pixel voltage Vp. Thus, the pixel voltage Vp varies simultaneously as the assist voltage Va varies due to the influence of the assist capacitor 48. The amount of change ΔVp in the pixel voltage Vp is generally in accordance with the following Expression 6.

$$\pm\Delta Vp=\pm\Delta Vax(Ca/(Ca+Clc)) \qquad \text{Expression 6}$$

Assist capacitance: Ca

Liquid crystal capacitance: Clc

Thus, a liquid crystal voltage Vlc, which is equal to the difference between the pixel voltage Vp and the common voltage Vc, is applied through the liquid crystal layer.

Figure 14:
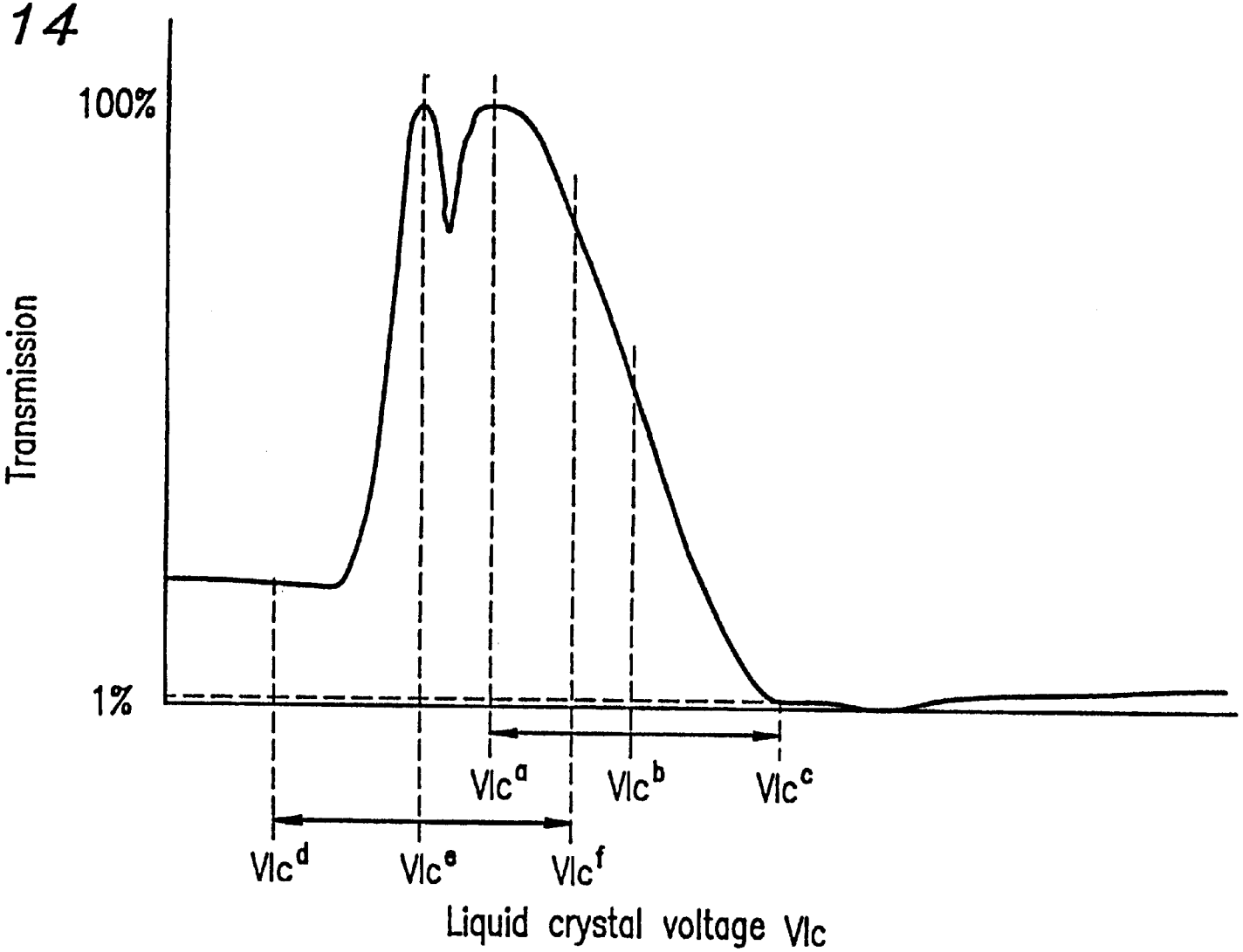
FIG. 14 illustrates the relationship between a liquid crystal voltage Vlc and a transmission for the liquid crystal display device according to Embodiment 4 of the present invention.

FIG. 14 illustrates the relationship between the liquid crystal voltage Vlc applied through the liquid crystal layer and the transmission. In this example, an OCB (optically compensated bend) type normally white mode is used as a liquid crystal display mode.

The output range $\pm Vs^{max}$ of the source voltage Vs is normally set to the voltage difference between a voltage $Vlc^{a}$ at which the 100% transmission is obtained and a voltage $Vlc^{c}$ at which about 1% transmission is obtained. Thus, the output range of the source voltage Vs is set to a minimum range required to obtain a practically sufficient contrast. When the output range of the source voltage Vs is set to be higher than this, a source driver having a high voltage resistance is required, thereby increasing the cost of the device.

In Embodiment 4, the liquid crystal voltage Vlc, the source voltage Vs, the common voltage Vc and the assist voltage Va are set to satisfy the relationship as shown in the following Expression 7.

$$Vlc^{a}=|\mp Vs^{max}\pm Vcac|$$

$$Vlc^{b}=|\pm Vcac|$$

$$Vlc^{c}=|\pm Vs^{max}\pm Vcac|$$

$$Vlc^{d}=|\mp Vs^{max}\pm Vcac\mp\Delta Vp|$$

$$Vlc^{e}=|\pm Vcac\mp\Delta Vp|$$

$$Vlc^{f}=|\pm Vs^{max}\pm Vcac\mp\Delta Vp| \qquad \text{Expression 7}$$

Therefore, even when the source voltage Vs has a voltage corresponding to the voltage of the image signals, the liquid crystal voltage Vlc to be applied is determined in the range from $Vlc^{d}$ to $Vlc^{f}$ for the assist signal application period, and in the range from $Vlc^a$ to $Vlc^c$ according to the image signal for the image signal application period.

Thus, the liquid crystal voltage Vlc which is obtained by adding a constant voltage difference ΔVp to the voltage corresponding to the image signal is applied during the assist signal application period, thereby setting an effective assist signal according to each image signal.

Figure 15:
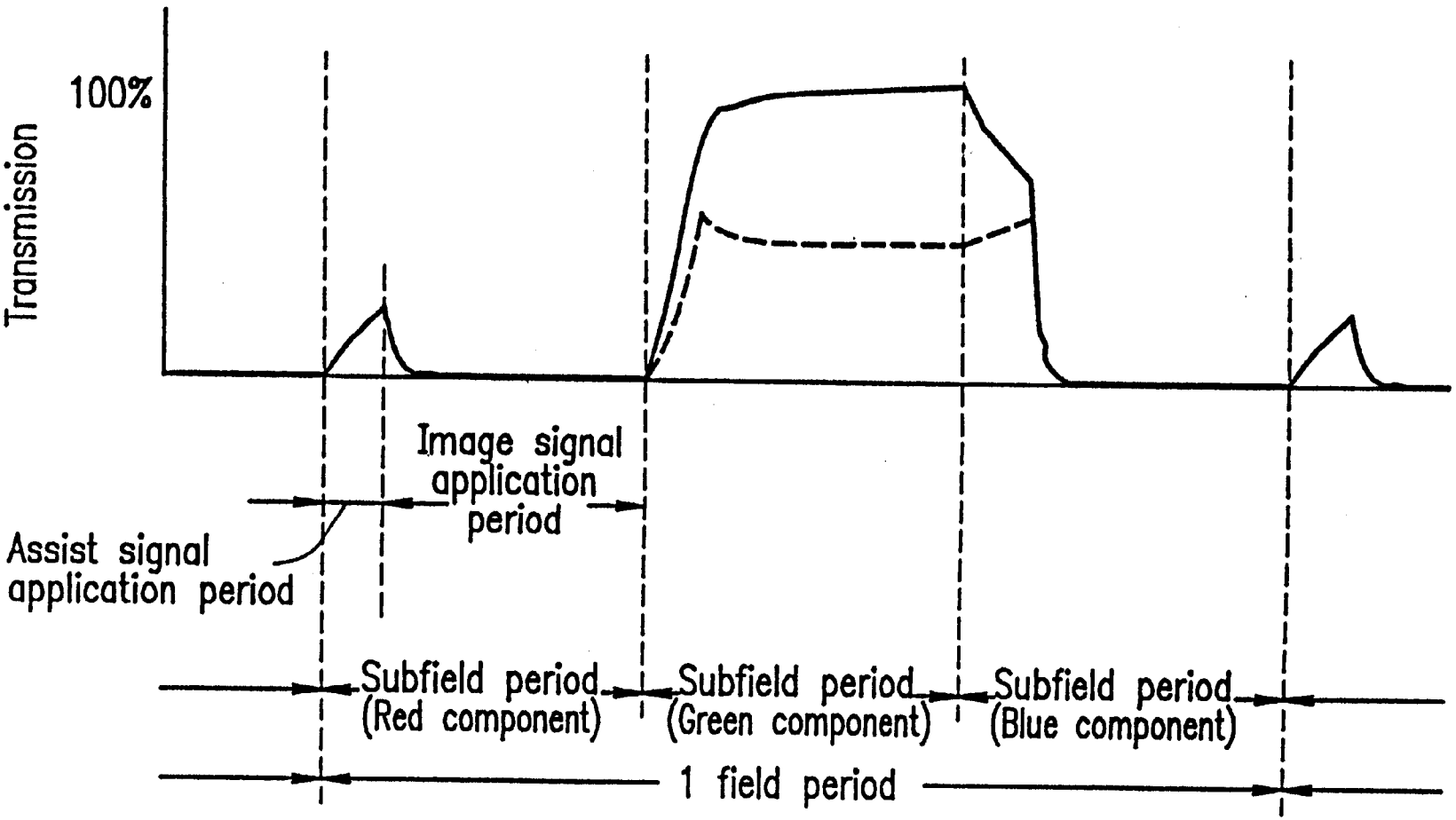
FIG. 15 illustrates a change in the transmission of the liquid crystal display device according to Embodiment 4 of the present invention.

Next, the change in the transmission through the liquid crystal layer according to Embodiment 4 will be described with reference to FIG. 15. In FIG. 15, a solid line shows the change in the transmission obtained when a voltage corresponding to an image signal for a bright green display is applied, and a broken line shows the change in the transmission obtained when a voltage corresponding to an image signal for a dark green display is applied.

In order to produce a bright green display, the liquid crystal panel is controlled to produce a black display during the red component subfield, a white display during the green component subfield, and a black display during the blue component subfield. This sequence of display operations is repeated to produce a bright green display. In order to produce a dark green display, the liquid crystal panel is controlled to produce a black display during the red component subfield, a gray-level display during the green component subfield, and a black display during the blue component subfield. This sequence of display operations is repeated to produce a dark green display.

As illustrated in FIG. 15, for each of the bright green display and the dark green display, a transmission corresponding to the image signal for each display color is reached within the corresponding subfield period, thereby obtaining a color display with a good reproducibility.

In Embodiment 4, the voltage for the assist signal application period is set to be lower than the voltage for the image signal application period, as illustrated in FIG. 14. This is because in the liquid crystal mode employed in Embodiment 4, the liquid crystal response is slower when the liquid crystal voltage is low than when it is high. By applying a low voltage during the assist signal application period, it is possible to selectively increase the liquid crystal response to a high-to-low voltage transition (rather than increasing the liquid crystal response to a low-to-high voltage transition).

In Embodiment 4, the liquid crystal voltage for the assist signal application period is not set to a voltage such that a constant transmission is always reached for all the image signals. Therefore, for an image signal corresponding to a black display (such as those for the red component subfield period and the blue component subfield period when a green display is being produced), the amount of change in the transmission toward the white display following the assist signal application period can be reduced so as to avoid an unnecessary liquid crystal response, so that a transmission corresponding to the next image signal can be reached more quickly. This is possible because the liquid crystal voltage applied during the assist signal application period for an image signal corresponding to a black display is higher than that for an image signal corresponding to a white display.

As described above, in Embodiment 4, the amount of voltage change between the image signal application period and the assist signal application period is constant irrespective of the image signal, whereby it is possible to effectively reduce the liquid crystal response time for any image signal. Thus, it is possible to shorten the assist signal application period and to prolong the image signal application period during which the image is displayed, thereby obtaining a bright display.

Moreover, a transmission corresponding to the image signal can be reached after the assist signal application period irrespective of the image signal which has been written in the pixel electrode during the previous field, whereby it is possible to avoid the influence of the image signal which has been written during the previous field and to obtain a display with a good color reproducibility.

Moreover, the source driver is only required to be able to output the voltage range for the image signals, and it is not necessary to increase the voltage resistance of the source driver due to the use of the assist voltage, thereby avoiding an increase in the production cost.

The image signal application period and the voltage shift amount ΔVp are not limited to those shown in Embodiment 4. These settings can be appropriately adjusted in view of the response performance of the liquid crystal material to be used. Moreover, the write period can be provided in the assist signal application period.

The settings of the common voltage Vc, the assist voltage Va and the source voltage Vs are also not limited to that shown in Embodiment 4. For example, a voltage lower than the liquid crystal voltage at which the transmission is minimum may be applied during the assist signal application period while employing a normally black mode as a liquid crystal display mode. The liquid crystal mode may be a mode other than an OCB mode.

The structure of the liquid crystal display device is also not limited to that shown in Embodiment 4. For example, it is possible to apply the present invention to a different type of a liquid crystal display device in which image signals are written in a line sequential manner or in a dot sequential manner in a plurality of pixel capacitors respectively connected to a plurality of scanning lines, and then voltages corresponding to the written image signals are transferred at once to the respective pixels electrodes after the write scanning operation.

Embodiment 5

Figure 16:
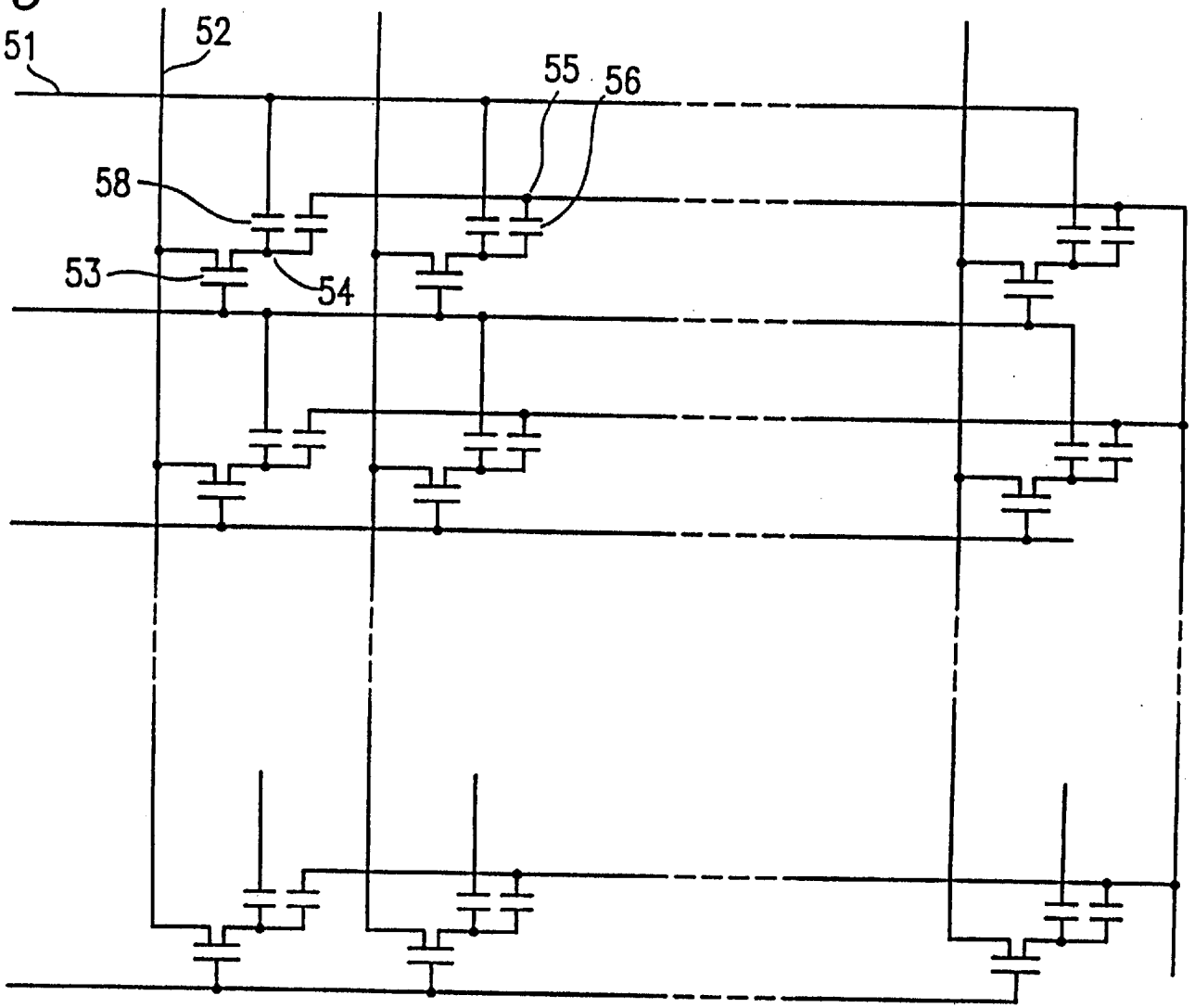
FIG. 16 illustrates an equivalent circuit diagram of a liquid crystal display device according to Embodiment 5 of the present invention.

FIG. 16 illustrates an equivalent circuit diagram of a liquid crystal display device according to Embodiment 5 of the present invention.

The liquid crystal display device includes a plurality of gate electrodes 51 and a plurality of source electrodes 52 crossing the gate electrodes 51. A thin film transistor as a switching element 53 is provided in the vicinity of each intersection of the gate electrode 51 and the source electrode 52. The display area is divided into a plurality of pixel regions arranged in a matrix, which are partitioned from one another by the gate electrodes 51 and the source electrodes 52. A pixel electrode 54 is provided in each of the pixel regions. The pixel electrode 54 is connected to the source electrode 52 via the switching element 53. A liquid crystal layer (not shown) is interposed between the pixel electrode 54 and a common electrode 55. A liquid crystal capacitor 56 is provided between the pixel electrode 54 and the common electrode 55. Moreover, an assist capacitor 58 is provided between the pixel electrode 54 and the gate electrode 51 in parallel to the liquid crystal capacitor 56. While the gate electrode 51 is also used as an assist electrode in Embodiment 5, a dedicated assist electrode may alternatively be provided.

Figure 17:
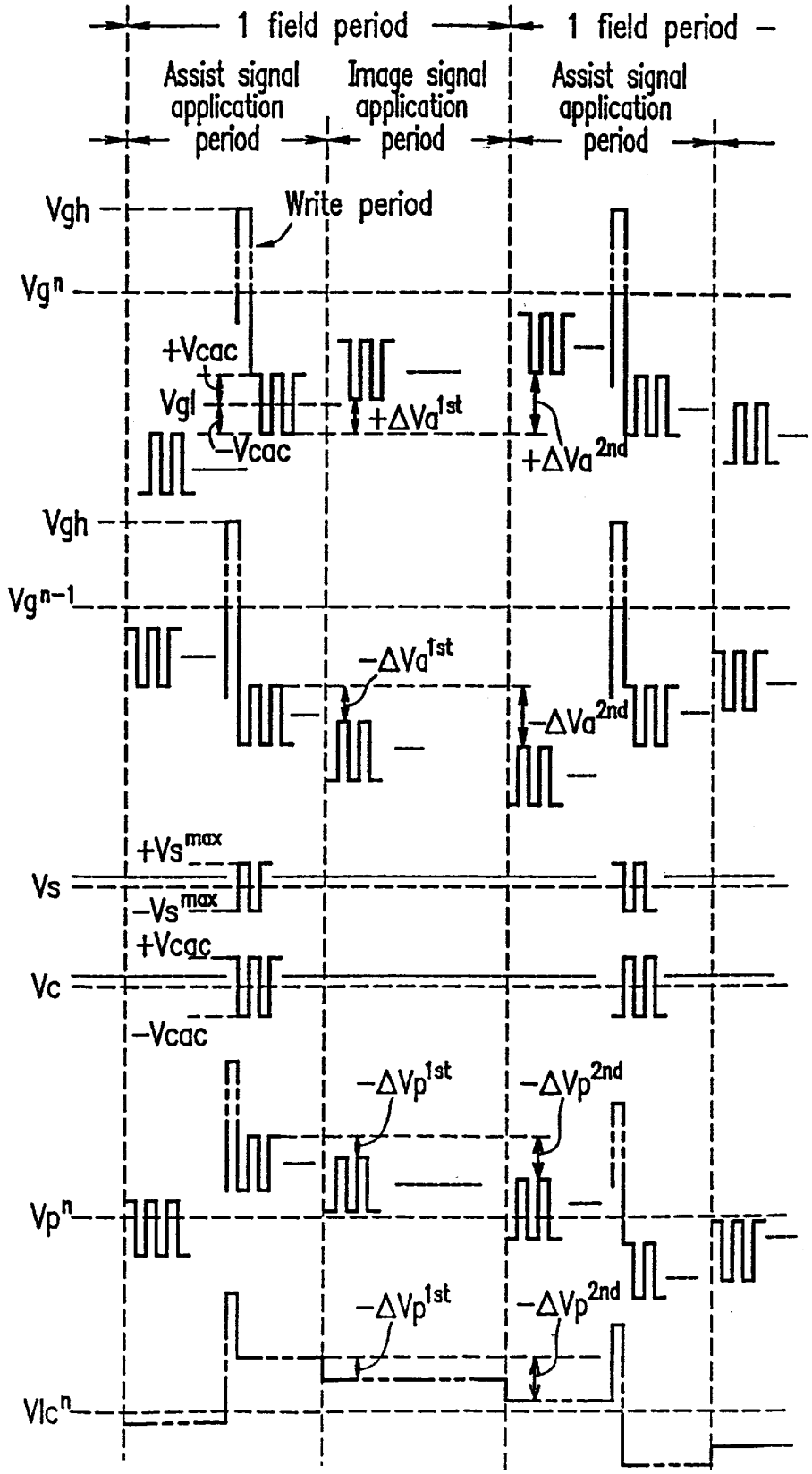
FIG. 17 illustrates voltage waveforms used for driving the liquid crystal display device according to Embodiment 5 of the present invention.

FIG. 17 illustrates voltage waveforms used for driving the liquid crystal display device.

Each field period includes an assist signal application period and an image signal application period. The assist signal application period includes a write period for writing an image signal to the pixel electrode 54 via the switching element 53. In Embodiment 5, the timing of the assist signal application period and the image signal application period is set for each row according to the timing of the write period.

A pulse waveform of ON voltage Vgh for turning ON the switching element 53 is applied as a gate voltage Vg to the gate electrodes 51 during a write period. An assist signal voltage ±ΔV is applied in synchronization with the write period. In FIG. 17, "$Vg^{n}$" denotes an $n^{th}$ gate electrode signal, and "$Vg^{n-1}$" denotes an $n-1^{th}$ gate electrode signal.

The assist signal voltage applied in the assist signal application period before the write period is different from that used in the assist signal application period after the write period. In the assist signal application period after the write period, a voltage obtained by adding a voltage of ±Vcac (as for the common voltage Vc) to the OFF voltage Vgl. During the image signal application period, a voltage obtained by shifting the assist signal voltage by $\pm\Delta Va^{1st}$ according to the polarity of the common voltage Vc during the write period is input during the image signal application period. In the assist signal application period before the write period, a voltage obtained by shifting assist signal voltage by $\pm\Delta Va^{2nd}$ is input. Thus, in Embodiment 5, the assist voltage is not simultaneously applied to every row as in Embodiments 3 and 4, but the assist voltage is applied to each row at the timing according to the pulse waveform of the ON voltage Vgh.

A voltage corresponding to an image signal for the row for which the ON voltage Vgh is being input to the gate electrode 51 during the write period is applied as a source voltage Vs to the source electrode 52. A plurality of such image signals are applied sequentially. In Embodiment 5, the source voltage Vs to be applied to the source electrode 52 is a voltage whose polarity is inverted for every horizontal scanning period and every subfield period.

The common voltage Vc to be applied to the common electrode 55 is a rectangular wave having an amplitude of ±Vcac. In Embodiment 5, the polarity of the common voltage Vc is inverted for every horizontal scanning period and every subfield period.

Each time the ON voltage Vgh is applied to the gate electrode 51, a new source voltage Vs is applied to the pixel electrode 54 as apixel voltage Vp. Thus, the pixel voltage Vp varies simultaneously as the assist voltage ±ΔVa is applied to the gate electrode 51 used as an assist electrode due to the influence of the assist capacitor 58. In FIG. 17, "$Vp^{n}$" denotes a voltage applied to the pixel electrode which forms an assist capacitor between the pixel electrode and the $n^{th}$ gate electrode. The amount of change ΔVp in the pixel voltage Vp is generally in accordance with the following Expression 8.

$$\pm\Delta Vp^{1st}=\pm\Delta Va^{1st}\times(Ca/(Ca+Clc))\pm\Delta Vp^{2nd}=\pm\Delta Va^{2nd}\times(Ca/(Ca+Clc))$$

Expression 8

Assist capacitance: Ca

Liquid crystal capacitance: Clc

Thus, a liquid crystal voltage Vlc, which is equal to the difference between the pixel voltage Vp and the common voltage Vc, is applied through the liquid crystal layer. In FIG. 17, "$Vlc^{n}$" denotes a voltage applied to the liquid crystal capacitor between the common electrode and the pixel electrode which forms an assist capacitor between the pixel electrode and the $n^{th}$ gate electrode.

Figure 18:
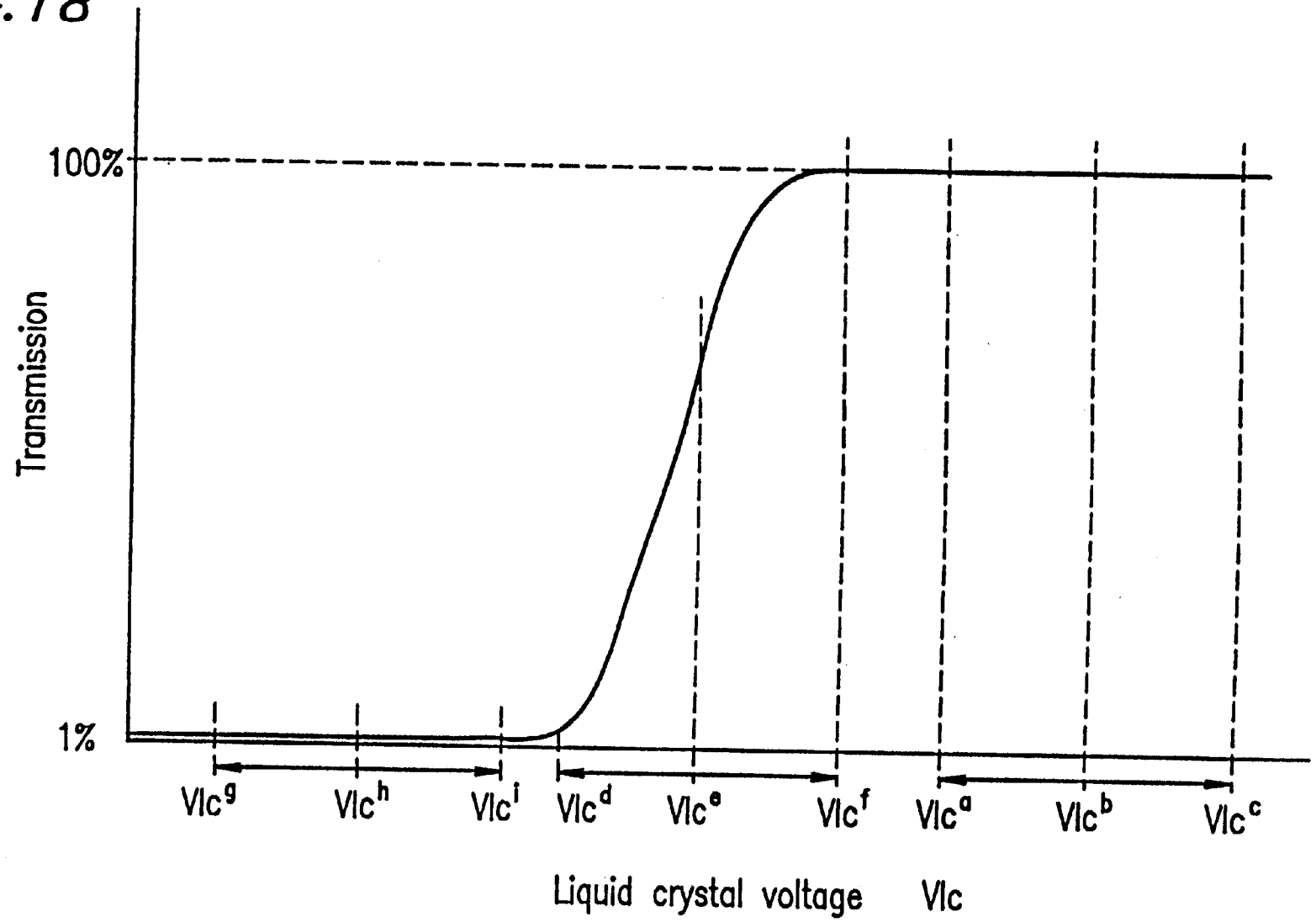
FIG. 18 illustrates the relationship between a liquid crystal voltage Vlc and a transmission for the liquid crystal display device according to Embodiment 5 of the present invention.

FIG. 18 illustrates the relationship between the liquid crystal voltage Vlc applied through the liquid crystal layer and the transmission. In this example, a TN type normally black mode (where the transmission is increased in the presence of an applied voltage) is used as a liquid crystal display mode.

The output range $\pm Vs^{max}$ of the source voltage Vs is normally set to the voltage difference between a voltage $Vlc^{a}$ at which the 100% transmission is obtained and a voltage $Vlc^{c}$ at which about 1% transmission is obtained. Thus, the output range of the source voltage Vs is set to a minimum range required to obtain a practically sufficient contrast. When the output range of the source voltage Vs is set to be higher than this, a source driver having a high voltage resistance is required, thereby increasing the cost of the device.

In Embodiment 5, the liquid crystal voltage Vlc, the source voltage Vs, the common voltage Vc and the assist voltage Va are set to satisfy the relationship as shown in the following Expression 9.

$$Vlc^{a}=|\mp Vs^{max}\pm Vcac|$$

$$Vlc^{b}=|\pm Vcac|$$

$$Vlc^{c}=|\pm Vs^{max}\pm Vcac|$$

$$Vlc^{d}=|\mp Vs^{max}\pm Vcac\mp\Delta Vp^{1st}|$$

$$Vlc^{e}=|\pm Vcac\mp\Delta Vp^{1st}|$$

$$Vlc^{f}=|\pm Vs^{max}\pm Vcac\mp\Delta Vp^{1st}|$$

$$Vlc^{g}=|\mp Vs^{max}\pm Vcac\mp\Delta Vp^{2nd}|$$

$$Vlc^{h}=|\pm Vcac\mp\Delta Vp^{2nd}|$$

$$Vlc^{i}=|\pm Vs^{max}\pm Vcac\mp\Delta Vp^{2nd}|$$

Expression 9

Therefore, even when the source voltage has a voltage corresponding to the voltage of the image signals, the liquid crystal voltage Vlc to be applied is determined in the range $Vlc^{g}$ to $Vlc^{i}$ according to the image signal for the assist signal application period before the write period, and in the range from $Vlc^{a}$ to $Vlc^{c}$ according to the image signal for the assist signal application period after the write period. Moreover, for the image signal application period, the liquid crystal voltage Vlc to be applied is determined in the range from $Vlc^{d}$ to $Vlc^{f}$ according to the image signal.

Thus, the liquid crystal voltage Vlc which is obtained by adding a constant voltage difference ΔVp to the voltage corresponding to the image signal is applied during the assist signal application period, thereby setting an effective assist signal according to each image signal.

Figure 19:
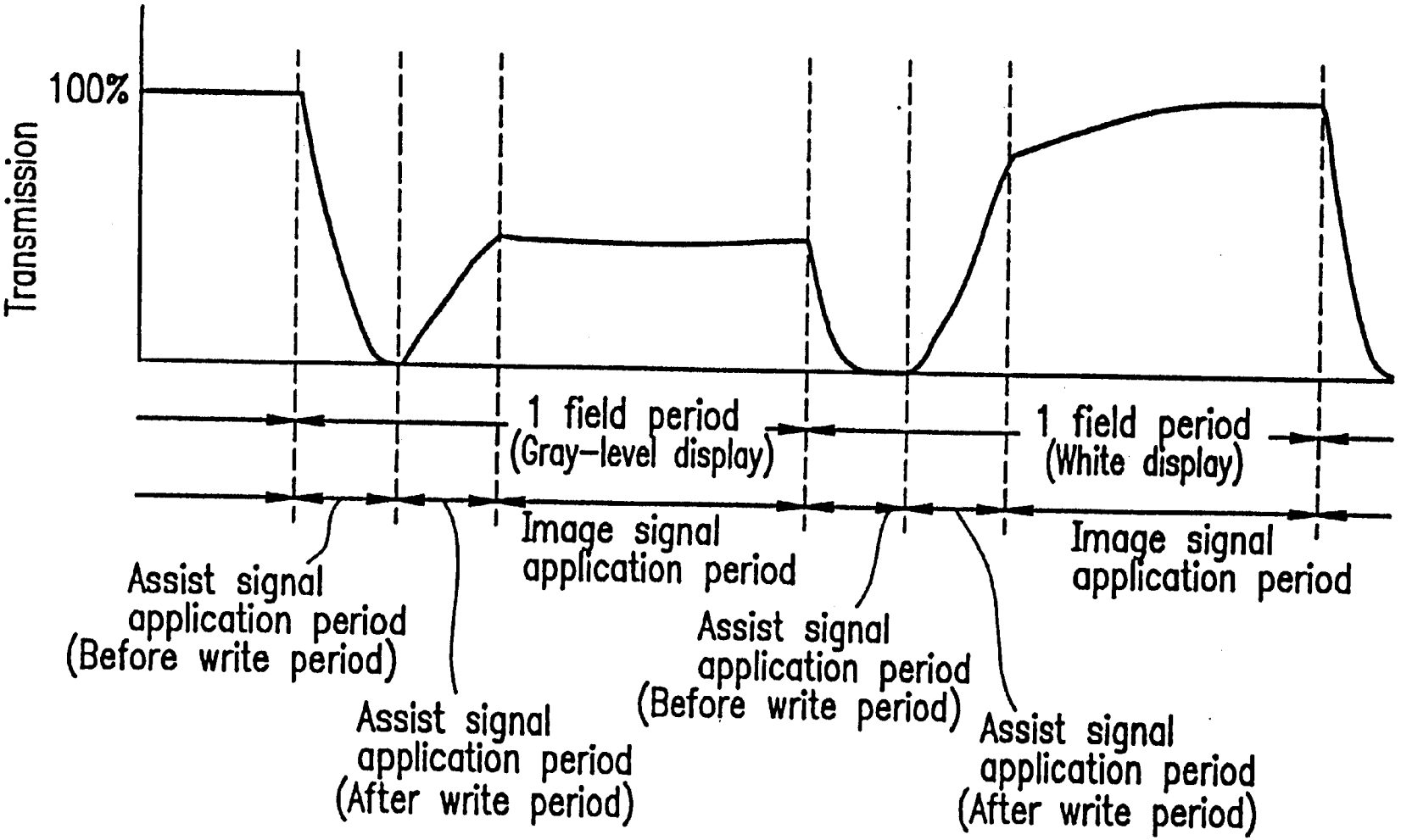
FIG. 19 illustrates a change in the transmission of the liquid crystal display device according to Embodiment 5 of the present invention.
Figure 20:
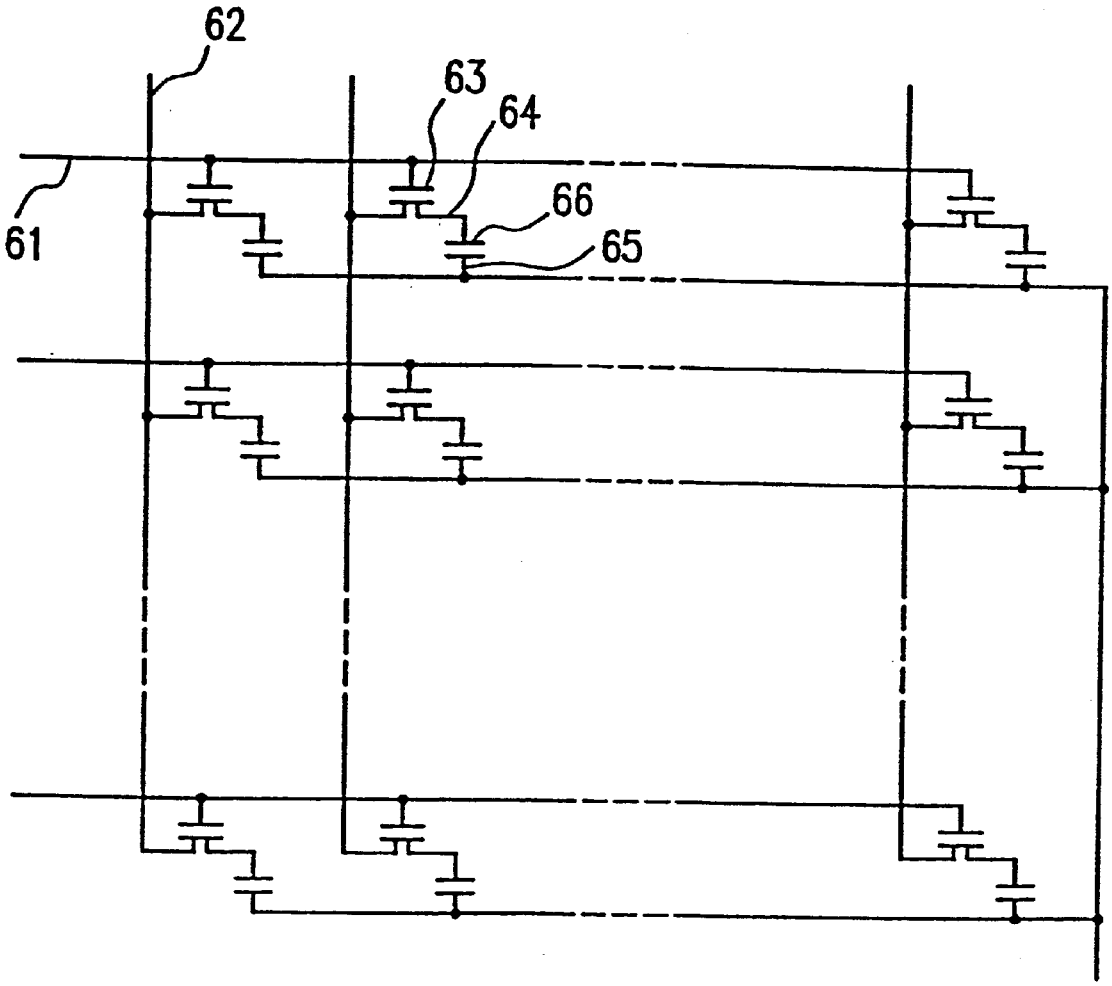
FIG. 20 RELATED ART
FIG. 20 illustrates an equivalent circuit diagram of a conventional liquid crystal display device.
Figure 21:
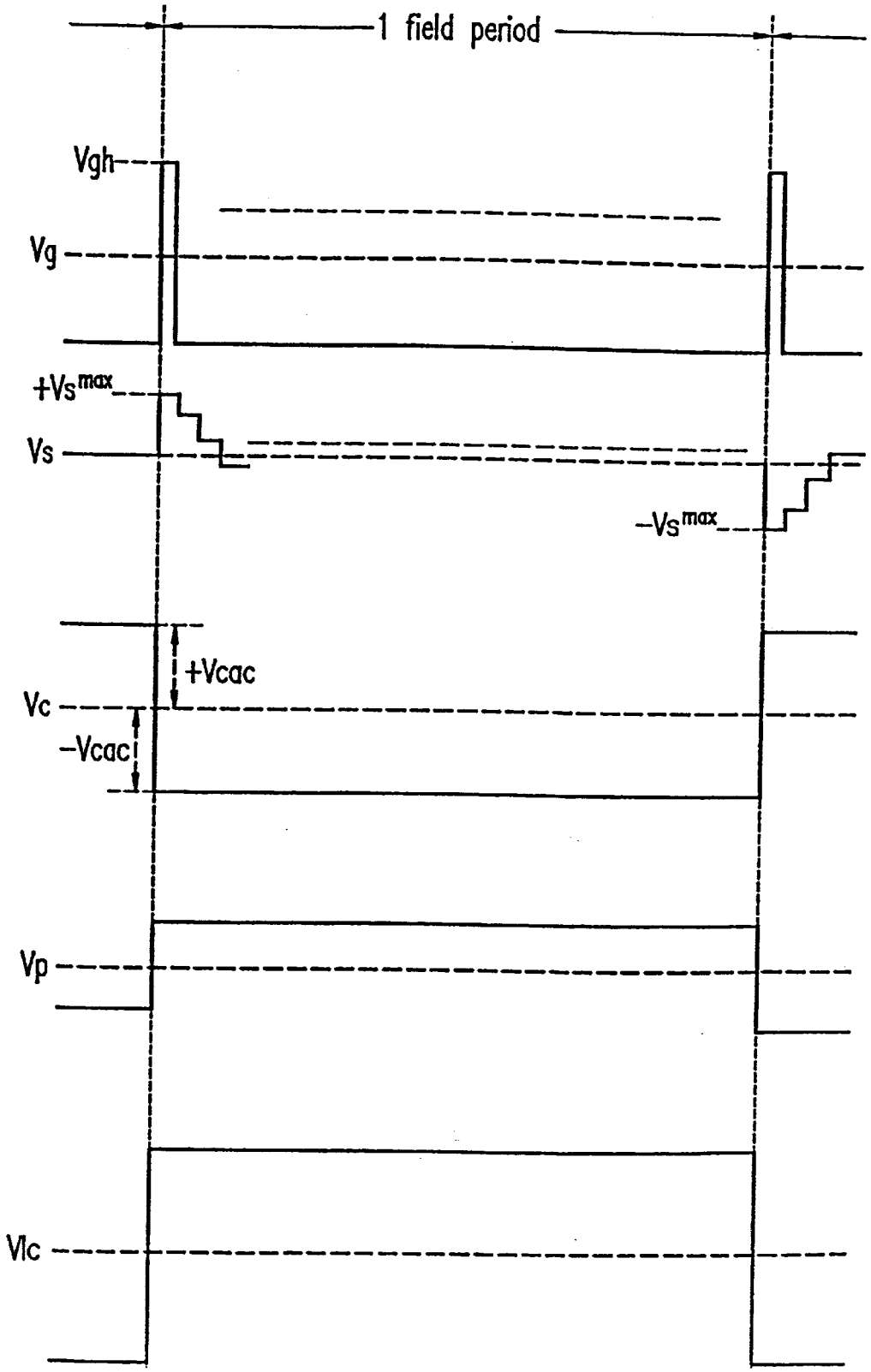
FIG. 21 RELATED ART
FIG. 21 illustrates voltage waveforms used for driving the conventional liquid crystal display device.
Figure 22:
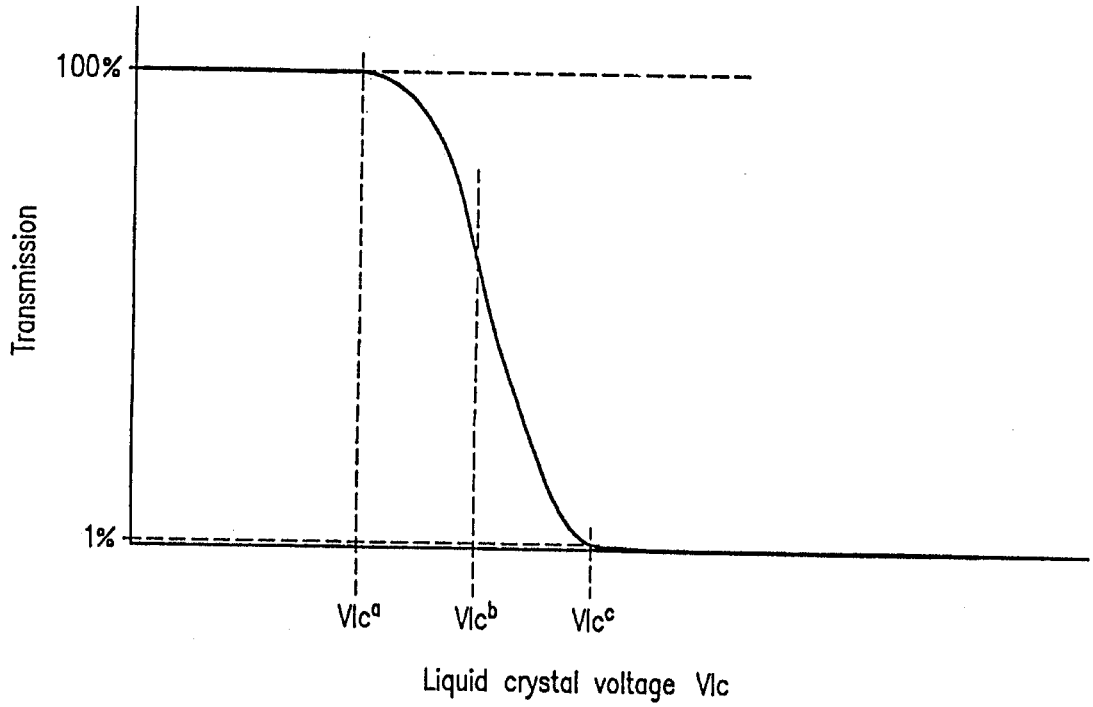
FIG. 22 RELATED ART
FIG. 22 illustrates the relationship between a liquid crystal voltage Vlc and a transmission for the conventional liquid crystal display device.
Figure 23:
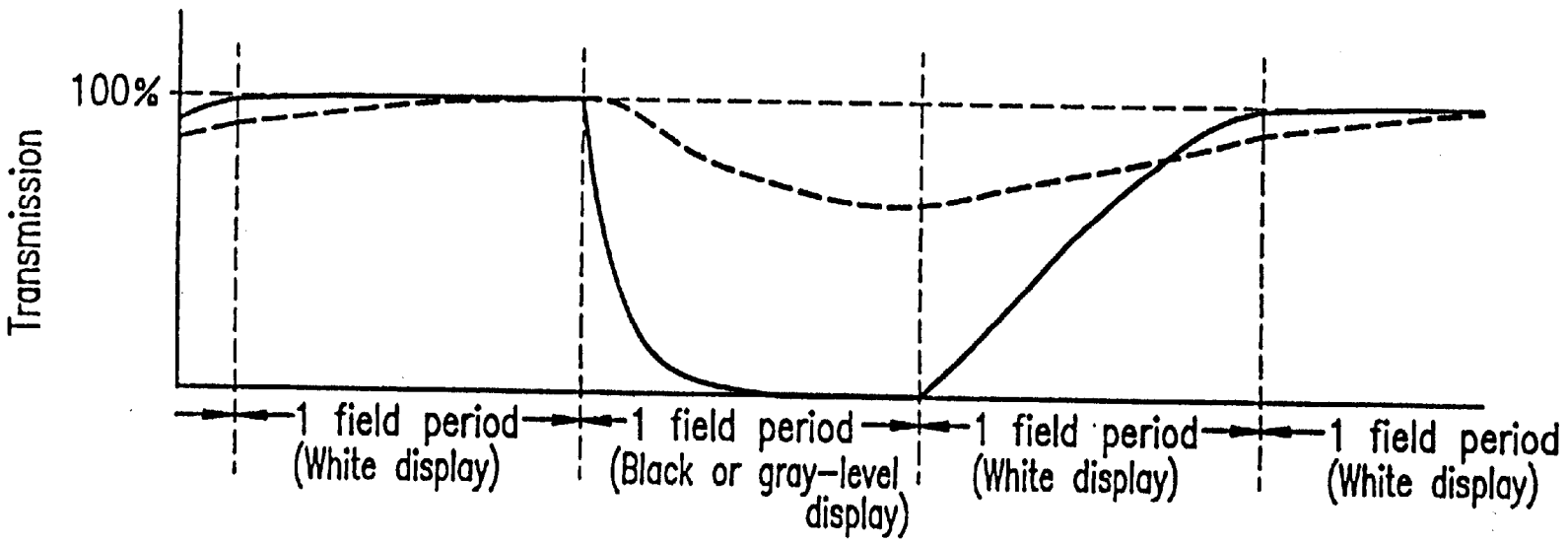
FIG. 23 RELATED ART
FIG. 23 illustrates a change in the transmission of the conventional liquid crystal display device.

Next, the change in the transmission through the liquid crystal layer according to Embodiment 5 will be described with reference to FIG. 19. FIG. 19 shows an exemplary change in the transmission obtained when alternately displaying a white display image signal and a gray-level display image signal.

As illustrated in FIG. 19, for each of the "white→gray-level" transition and the "gray-level→white" transition, the transmission reaches the black display level before the write period during the assist signal application period, and the transmission shows a transitional response toward a white display after the write period during the assist signal application period and changes to an appropriate level according to the white or gray-level image signal during the image signal application period.

Thus, each image signal can be written on a black display, whereby the image signal write operation is not influenced by the previously written image signal. Moreover, because the transitional response toward a white display is provided after the write period during the assist signal application period, the transmission can reach an appropriate level according to the image signal during the image signal application period even for a transition to a gray-level display for which the liquid crystal response is normally slow.

When the image signal is a white display signal, the liquid crystal voltage Vlc is set to $Vlc^i$ (FIG. 18) during the assist signal application period before the write period, $Vlc^c$ (FIG. 18) during the assist signal application period after the write period, and $Vlc^f$ which is determined according to the image signal during the image signal application period. When the image signal is a gray-level signal, the liquid crystal voltage Vlc is set to $Vlc^h$ (FIG. 18) during the assist signal application period before the write period, $Vlc^b$ (FIG. 18) during the assist signal application period after the write period, and $Vlc^e$ which is determined according to the image signal during the image signal application period.

In Embodiment 5, the amount of voltage change between an image signal application period and an assist signal application period is constant irrespective of the image signal, whereby it is possible to effectively reduce the liquid crystal response time for any image signal. Thus, it is possible to shorten the assist signal application period and to prolong the image signal application period during which the image is displayed, thereby obtaining a bright display.

Moreover, a black display transmission is reached during the assist signal application period irrespective of the image signal which has been written in the pixel electrode during the previous field, whereby it is possible to prevent a motion picture from being blurred or having an after-image due to the influence from the image signal which has been written during the previous field and thus to obtain a bright display. Moreover, the source driver is only required to be able to output the voltage range for the image signals, and it is not necessary to increase the voltage resistance of the source driver due to the use of the assist voltage, thereby avoiding an increase in the production cost. Furthermore, Embodiment 5, in which the assist signal application period can be set to any period without changing the write period, would not require a switching element having a high charging capability. The assist capacitor of the present invention also has an effect of compensating for charge leakage which occurs due to, for example, the insufficient holding capability of the liquid crystal capacitor.

The relationship between the voltage difference ΔVp and the response speed of the liquid crystal panel will now be described. When the voltage difference $\Delta Vp^{2nd}$ is set to a relatively large value, the amount of change in the liquid crystal voltage during the assist signal application period before the write period increases, thereby reaching a black display transmission in a shorter period of time. However, when the voltage difference $\Delta Vp^{2nd}$ is excessively large, the transition from the black display to the image signal display will be slow. When the voltage difference $\Delta Vp^{1st}$ is set to a relatively large value, the amount of change in the liquid crystal voltage during the assist signal application period after the write period increases, thereby increasing the response speed toward a white display. Thus, the response speed toward a white display is increased, thereby increasing the response speed toward the image signal display. However, when the voltage difference $\Delta Vp^{1st}$ is excessively large, there will be a response toward a white display even when the image signal is a black display signal, thereby lowering the response speed to the image signal. Thus, it is possible to effectively increase the response speed of the liquid crystal panel and shorten the assist signal application period by optimizing the voltage difference ΔVp in view of the response performance of the liquid crystal material to be used.

The settings of the write period and the setting of the number of times the assist voltage changes during an assist signal application period are not limited to those shown in Embodiment 5. These settings can be appropriately adjusted in view of the response performance of the liquid crystal material to be used. Moreover, while the assist signal application period is provided before and after the write period in Embodiment 5, the assist signal application period may alternatively be provided only after the write period.

The settings of the common voltage Vc, the assist voltage Va and the source voltage Vs are also not limited to that shown in Embodiment 5. For example, these values may alternatively be set so that a black display is provided during the assist signal application period while employing a normally white mode. The liquid crystal mode may be a mode other than a TN mode.

When the driving method described in Embodiment 5 is employed in combination with the field sequential color method, the voltages can be set so that all rows simultaneously enter the image signal application period. As an alternative method, the light from the light source may be scanned over a plurality of rows at a timing coordinated with the timing at which the voltage for the assist signal application period is scanned over the plurality of rows.

In Embodiment 5, both the common voltage and the assist voltage or both the gate voltage and the assist voltage may have different values between the image signal application period and the assist signal application period. In such a case, the common and assist voltages or the gate and assist voltages need to have different amounts of voltage change between the image signal application period and the assist signal application period. Moreover, the pixel electrodes and/or the counter electrodes may alternatively be arranged in a comb-like pattern.

As described above in detail, according to the present invention, it is possible to effectively increase the liquid crystal response speed for any image signal, without being influenced by the previously written image signal. Therefore, it is possible to prevent a motion picture from being blurred or having an after-image. Moreover, when the present invention is applied to the field sequential color method, it is possible to realize a color display with a good color reproducibility. Furthermore, it is possible to prolong the period during which an image is displayed, thereby obtaining a bright display.

Without providing an assist signal voltage from a source driver, it is possible to apply through the liquid crystal layer different voltages according to the image signal between the image signal application period and the assist signal application period. Therefore, it is not necessary to increase the voltage resistance of the source driver due to the use of the assist voltage, thereby avoiding an increase in the production cost. Since the assist signal voltage is not provided from the source driver, the power consumption can be reduced. Moreover, a decrease in the length of one horizontal scanning period can be eliminated or prevented, whereby it is not necessary to provide a high-performance switching element. Therefore, it is possible to realize a liquid crystal display device having a high display quality with a low cost.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A liquid crystal display device, comprising:

a plurality of first electrodes;

a plurality of second electrodes crossing the first electrodes;

a plurality of switching elements each provided in a vicinity of an intersection of a first electrode and a second electrode;

a plurality of pixel electrodes respectively provided in a plurality of regions which are arranged in a matrix and partitioned from one another by the first electrodes and the second electrodes;

a plurality of the first electrodes to each of which a gate voltage is applied for turning ON/OFF each of the switching elements;

a plurality of the second electrodes to each of which a source voltage is applied; and a plurality of third electrodes to each of which a common voltage is applied, the third electrodes being arranged so that a liquid crystal layer is interposed between the third electrodes and the pixel electrodes, wherein:

the source voltage comprises a voltage corresponding to an image signal and another voltage corresponding to an assist signal; and the common voltage has different values between an image signal writing scanning period and at least one assist signal writing scanning period, the image signal writing scanning period being defined as a period during which the voltage corresponding to the image signal is applied, and the assist signal writing scanning period being defined as a period during which the voltage corresponding to the assist voltage is applied.

2. A liquid crystal display device according to claim 1, wherein a liquid crystal capacitor is provided between one of the pixel electrodes and one of the third electrodes.

3. A liquid crystal display device according to claim 1, wherein a liquid crystal capacitor is provided between one of the pixel electrodes and one of the second electrodes.

4. A liquid crystal display device, comprising:

a plurality of first electrodes;

a plurality of second electrodes crossing the first electrodes;

a plurality of switching elements each provided in a vicinity of an intersection of a first electrode and a second electrode;

a plurality of pixel electrodes respectively provided in a plurality of regions which are arranged in a matrix and partitioned from one another by the first electrodes and the second electrodes;

a plurality of the first electrodes to each of which a gate voltage is applied for turning ON/OFF each of the switching elements;

a plurality of the second electrodes to each of which a source voltage is applied; and a plurality of third electrodes to each of which a common voltage is applied, the third electrodes being arranged so that a liquid crystal layer is interposed between the third electrodes and the pixel electrodes, wherein:

the liquid crystal display device further comprises a plurality of assist electrodes to each of which an assist voltage is applied, the assist electrodes having an assist capacitor being provided between each of the pixel electrodes and each of the assist electrodes;

an image signal application period is defined as a period during which a voltage corresponding to an image signal is applied between the pixel electrode and the third electrode;

an assist signal application period is defined as a period during which a voltage corresponding to an assist signal is applied between the pixel electrode and the third electrode; and the common voltage has different values between the image signal application period and the assist signal application period or the assist voltage has different values during the assist signal application period.

5. A liquid crystal display device, comprising:

a plurality of first electrodes;

a plurality of second electrodes crossing the first electrodes;

a plurality of switching elements each provided in a vicinity of an intersection of a first electrode and a second electrode;

a plurality of pixel electrodes respectively provided in a plurality of regions which are arranged in a matrix and partitioned from one another by the first electrodes and the second electrodes;

a plurality of the first electrodes to each of which a gate voltage is applied for turning ON/OFF each of the switching elements;

a plurality of the second electrodes to each of which a source voltage is applied; and a plurality of third electrodes to each of which a common voltage is applied, the third electrodes being arranged so that a liquid crystal layer is interposed between the third electrodes and the pixel electrodes, wherein:

the liquid crystal display device further comprises a plurality of assist electrodes to each of which an assist voltage is applied, the assist electrodes having an assist capacitor being provided between each of the pixel electrodes and each of the first electrodes;

an image signal application period is defined as a period during which a voltage corresponding to an image signal is applied between the pixel electrode and the third electrode;

an assist signal application period is defined as a period during which a voltage corresponding to an assist signal is applied between the pixel electrode and the third electrode; and the common voltage has different values between the image signal application period and the assist signal application period or the assist voltage has different values during the assist signal application period.

6. A method for driving a liquid crystal display device, the liquid crystal display device comprising:

a plurality of first electrodes;

a plurality of second electrodes crossing the first electrodes;

a plurality of switching elements each provided in a vicinity of an intersection of a first electrode and a second electrode;

a plurality of pixel electrodes respectively provided in a plurality of regions which are arranged in a matrix and partitioned from one another by the first electrodes and the second electrodes;

a plurality of the first electrodes to each of which a gate voltage is applied for turning ON/OFF each of the switching elements;

a plurality of the second electrodes to each of which a source voltage is applied; and a plurality of third electrodes to each of which a common voltage is applied, the third electrodes being arranged so that a liquid crystal layer is interposed between the third electrodes and the pixel electrodes, wherein:

the source voltage comprises a voltage corresponding to an image signal and another voltage corresponding to an assist signal, the method comprising the steps of:

applying the common voltage during an image signal writing scanning period which is defined as a period during which the voltage corresponding to the image signal voltage is applied; and applying the common voltage during at least one assist signal writing scanning period which is defined as a period during which the voltage corresponding to the assist signal voltage is applied, wherein:

the common voltage has different values between the image signal writing scanning period and the at least one assist signal writing scanning period.

7. A liquid crystal display device driving method according to claim 6, wherein a liquid crystal capacitor is provided between one of the pixel electrodes and one of the third electrodes.

8. A liquid crystal display device driving method according to claim 6, wherein a liquid crystal capacitor is provided between one of the pixel electrodes and one of the second electrodes.

9. A liquid crystal display device driving method according to claim 7, a range of a voltage applied to the liquid crystal capacitor during each assist signal writing scanning period is greater than a range of a voltage applied to the liquid crystal capacitor during the image signal writing scanning period.

10. A liquid crystal display device driving method according to claim 8, a range of a voltage applied to the liquid crystal capacitor during each assist signal writing scanning period is greater than a range of a voltage applied to the liquid crystal capacitor during the image signal writing scanning period.

11. A liquid crystal display device driving method according to claim 6, wherein the source voltage applied during the assist signal writing scanning period comprises a voltage for producing a black display or a white display.

12. A liquid crystal display device driving method according to claim 6, wherein the source voltage applied during the assist signal writing scanning period comprises a maximum voltage or a minimum voltage which can be output by a source voltage generation circuit for generating the source voltage.

13. A liquid crystal display device driving method according to claim 6, wherein:

one field period includes at least two subfield periods including the image signal writing scanning period and the assist signal writing scanning period; and a voltage corresponding to an image signal for a predetermined color component for each of the subfield periods is applied as the source voltage during the image signal writing scanning period.

14. A liquid crystal display device driving method according to claim 6, wherein the one field period includes:

a subfield period for displaying a red component;

a subfield period for displaying a green component; and a subfield period for displaying a blue component.

15. A method for driving a liquid crystal display device, the liquid crystal display device comprising:

a plurality of first electrodes;

a plurality of second electrodes crossing the first electrodes;

a plurality of switching elements each provided in a vicinity of an intersection of a first electrode and a second electrode;

a plurality of pixel electrodes respectively provided in a plurality of regions which are arranged in a matrix and partitioned from one another by the first electrodes and the second electrodes;

a plurality of the first electrodes to each of which a gate voltage is applied for turning ON/OFF each of the switching elements;

a plurality of the second electrodes to each of which a source voltage is applied; and a plurality of third electrodes to each of which a common voltage is applied, the third electrodes being arranged so that a liquid crystal layer is interposed between the third electrodes and the pixel electrodes, wherein:

the liquid crystal display device further comprises a plurality of assist electrodes to each of which an assist voltage is applied, the assist electrodes having an assist capacitor being provided between each of the pixel electrodes and each of the assist electrodes, the method comprising the steps of:

applying a voltage corresponding to the image signal voltage between the pixel electrode and the third electrode during an image signal application period; and applying a voltage corresponding to the assist signal voltage is applied between the pixel electrode and the third electrode during an assist signal application period, wherein:

the common voltage has different values between the image signal application period and the assist signal application period or the assist voltage has different values during the assist voltage application period.

16. A method for driving a liquid crystal display device according to claim 15, wherein a plurality of rows of assist electrodes receive alternately different signals.

17. A liquid crystal display device driving method according to claim 15, wherein a voltage which takes two or more levels is applied during the assist signal application period to one of at least one of the third electrodes and at least one of the assist electrodes.

18. A liquid crystal display device driving method according to claim 15, wherein:

a write period is provided during which a voltage corresponding to an image signal is applied to the pixel electrodes via the switching elements;

a first assist signal application period including the write period and a second assist signal application period not including the write period are provided; and a polarity of a voltage between the pixel electrodes and the third electrodes is reversed with respect to a polarity of a voltage applied during the image signal application period between the write period and the second assist signal application period.

19. A liquid crystal display device driving method according to claim 15, wherein the voltage for the assist signal application period is simultaneously applied to a plurality of pixels.

20. A liquid crystal display device driving method according to claim 15, wherein the assist signal application period is coordinated with a timing at which the voltage corresponding to the image signal is applied to each of the pixel electrodes.

21. A liquid crystal display device driving method according to claim 15, wherein a voltage exceeding a voltage range to be applied during the image signal application period is applied between the pixel electrodes and the third electrodes during the assist signal application period.

22. A liquid crystal display device driving method according to claim 15, wherein:

one field period includes at least two subfield periods including the image signal application period and the assist signal application period; and a voltage corresponding to an image signal for a predetermined color component for each of the subfield periods is applied between the pixel electrodes and the third electrodes during the image signal application period.

23. A liquid crystal display device driving method according to claim 15, wherein the one field period includes:

a subfield period for displaying a red component;

a subfield period for displaying a green component; and a subfield period for displaying a blue component.

24. A method for driving a liquid crystal display device, the liquid crystal display device comprising:

a plurality of first electrodes;

a plurality of second electrodes crossing the first electrodes;

a plurality of switching elements each provided in a vicinity of an intersection of a first electrode and a second electrode;

a plurality of pixel electrodes respectively provided in a plurality of regions which are arranged in a matrix and partitioned from one another by the first electrodes and the second electrodes;

a plurality of the first electrodes to each of which a gate voltage is applied for turning ON/OFF each of the switching elements;

a plurality of the second electrodes to each of which a source voltage is applied; and a plurality of third electrodes to each of which a common voltage is applied, the third electrodes being arranged so that a liquid crystal layer is interposed between the third electrodes and the pixel electrodes, wherein:

the liquid crystal display device further comprises a plurality of assist electrodes to each of which an assist voltage is applied, the assist electrodes having an assist capacitor being provided between each of the pixel electrodes and each of the first electrodes, the method comprising the steps of:

applying a voltage corresponding to an image signal between the pixel electrode and the third electrode during an image signal application period; and applying a voltage corresponding to an assist signal is applied between the pixel electrode and the third electrode during an assist signal application period, wherein:

the common voltage has different values between the image signal application period and the assist signal application period or the assist voltage has different values during the assist signal application period.

25. A liquid crystal display device driving method according to claim 24, wherein a voltage which takes two or more levels is applied during the assist signal application period to one of at least one of the third electrodes and at least one of the first electrodes.

26. A liquid crystal display device driving method according to claim 24, wherein:

a write period is provided during which a voltage corresponding to an image signal is applied to the pixel electrodes via the switching elements;

a first assist signal application period including the write period and a second assist signal application period not including the write period are provided; and a polarity of a voltage between the pixel electrodes and the third electrodes is reversed with respect to a polarity of a voltage applied during the image signal application period between the write period and the second assist signal application period.

27. A liquid crystal display device driving method according to claim 24, wherein the voltage for the assist signal application period is simultaneously applied to a plurality of pixels.

28. A liquid crystal display device driving method according to claim 24, wherein the assist signal application period is coordinated with a timing at which the voltage corresponding to the image signal is applied to each of the pixel electrodes.

29. A liquid crystal display device driving method according to claim 24, wherein a voltage exceeding a voltage range to be applied during the image signal application period is applied between the pixel electrodes and the third electrodes during the assist signal application period.

30. A liquid crystal display device driving method according to claim 24, wherein:

one field period includes at least two subfield periods including the image signal application period and the assist signal application period; and a voltage corresponding to an image signal for a predetermined color component for each of the subfield periods is applied between the pixel electrodes and the third electrodes during the image signal application period.

31. A liquid crystal display device driving method according to claim 24, wherein the one field period includes:

a subfield period for displaying a red component;

a subfield period for displaying a green component; and a subfield period for displaying a blue component.

* * * * *